US008938178B2

(12) United States Patent
Tanaka et al.

(10) Patent No.: US 8,938,178 B2
(45) Date of Patent: Jan. 20, 2015

(54) HEATER CONTROL DEVICE, FIXING DEVICE, AND IMAGE FORMING APPARATUS

(71) Applicant: Konica Minolta, Inc., Chiyoda-ku (JP)

(72) Inventors: Toshiaki Tanaka, Toyokawa (JP); Yasuhiro Ishihara, Toyohashi (JP); Kosuke Sasaki, Yokohama (JP)

(73) Assignee: Konica Minolta, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/028,664

(22) Filed: Sep. 17, 2013

(65) Prior Publication Data

US 2014/0079425 A1 Mar. 20, 2014

(30) Foreign Application Priority Data

Sep. 20, 2012 (JP) ..... 2012-206874

(51) Int. Cl.
*G03G 15/00* (2006.01)
*G03G 15/20* (2006.01)

(52) U.S. Cl.
CPC ..... *G03G 15/205* (2013.01); *G03G 2215/2035* (2013.01)
USPC ..... 399/88; 399/67; 399/69

(58) Field of Classification Search
USPC ..... 399/38, 67–70, 75, 88, 320, 328; 219/216, 619
See application file for complete search history.

(56) References Cited

U.S. PATENT DOCUMENTS

| | | | | |
|---|---|---|---|---|
| 7,853,164 | B2 * | 12/2010 | Sanada et al. | 399/69 |
| 8,244,150 | B2 * | 8/2012 | Kumada et al. | 399/69 |
| 8,526,836 | B2 * | 9/2013 | Mitsuoka et al. | 399/69 |
| 2011/0299903 | A1 | 12/2011 | Yamamoto et al. | |

FOREIGN PATENT DOCUMENTS

| | | | |
|---|---|---|---|
| JP | 10-091037 | A | 4/1998 |
| JP | 2011-253055 | A | 12/2011 |
| JP | 2012-088444 | A | 5/2012 |
| JP | 2012-132946 | A | 7/2012 |

OTHER PUBLICATIONS

Office Action issued on Oct. 28, 2014, by the Japanese Patent Office in Japanese Patent Application No. 2012-206874 and an English translation of the Office Action (5 pages).

* cited by examiner

*Primary Examiner* — Hoan Tran
(74) *Attorney, Agent, or Firm* — Buchanan Ingersoll & Rooney PC

(57) ABSTRACT

A heater control device that performs phase control of AC power and supplies phase-controlled power to a heater, the heater control device including: a control unit configured to, in the phase control, gradually increase an on-duty ratio until a target power amount is supplied to the heater; and a judgment unit configured to judge whether or not the on-duty ratio is within a predetermined range of on-duty ratios including a 50% on-duty ratio. The control unit (i) increases the on-duty ratio by a first amount while the on-duty ratio is within the predetermined range, and (ii) increases the on-duty ratio by a second amount while the on-duty ratio is not within the predetermined range. The first amount is greater than the second amount.

19 Claims, 13 Drawing Sheets

FIG. 8

| Difference between target temperature and detection temperature [°C] | Target power amount [W] |
|---|---|
| 10 | 1000 |
| 9 | 975 |
| 8 | 950 |
| 7 | 925 |
| 6 | 900 |
| 5 | 875 |
| 4 | 850 |
| 3 | 825 |
| 2 | 800 |
| 1 | 775 |
| 0 | 750 |
| -1 | 725 |
| -2 | |

HEATER CONTROL DEVICE, FIXING DEVICE, AND IMAGE FORMING APPARATUS

This application is based on application No. 2012-206874 filed in Japan, the content of which is hereby incorporated by reference.

BACKGROUND OF THE INVENTION (1) Field of the Invention

The present invention relates to a heater control device used in, for instance, a fixing device that fixes, onto a recording sheet, a toner image having been transferred onto the recording sheet, a fixing device including a heater control device, and an image forming apparatus.

(2) Description of Related Art

An electro-photographic image forming apparatus, such as a printer and a copier, is provided with a fixing device that fixes, onto a recording sheet such as a piece of paper and an OHP sheet, a toner image having been transferred onto the recording sheet. As a heater for heating toner transferred onto a recording sheet, such a fixing device includes, for instance, a halogen lamp or a resistance heating element.

As conventional technology related to a heater used in a fixing device, a technology is known of performing phase control of alternating power (hereinafter referred to as "AC" power) supplied from a commercial AC power source and supplying phase-controlled power to a heater used in a fixing device. Here, the phase control is performed to reduce a so-called "inrush current" that is generated upon commencement of power supply to the heater as much as possible.

The phase control as described above involves controlling a phase angle of AC power such that an on-duty ratio gradually increases, and thereby gradually increasing the amount of power supplied to the heater. Here, the term "on-duty ratio" indicates a ratio of a period during which power supply to the heater is performed within a half-cycle of AC power. By performing the phase control as described above, a rapid change in voltage taking place when power supply to the heater is commenced can be suppressed. This further realizes suppressing the generation of flicker in a lighting fixture, etc., that receives commercial AC power via the same power supply line as the heater (refer to Japanese Patent Application Publication No. H10-91037, for example).

However, the phase control as described above, which involves switching on and off the power supply to the heater within each half-cycle of the AC power, leads to a risk of harmonic currents appearing on the power supply line to which the heater and other electric devices are connected.

Such harmonic currents appearing on the power supply line negatively affect the other electric devices connected to and receiving AC power from the same power supply line as the heater, and therefore are problematic. Examples of negative effects that harmonic currents bring about in electric devices include: the degradation of electric parts such as capacitors in the electric devices, and in cases where the electric devices are communication devices in particular, generation of noises and improper displaying of images. In view of such problems posed by harmonic currents, the International Electrotechnical Commission (IEC) has adopted standards related to the restriction of harmonic currents (hereinafter referred to as "harmonic current related standards"). According to such standards, restriction is imposed on harmonic currents such that an average of current values of a harmonic current generated within a predetermined time period equals or falls below a predetermined threshold value.

Here, it should be noted that the phase control disclosed in Japanese Patent Application Publication No. H10-91037 involves simply increasing the on-duty ratio by a fixed amount for each hertz. Thus, when employing the phase control disclosed in Japanese Patent Application Publication No. H10-91037 and setting the fixed amount to a small value, a relatively great amount of time is required until a target power amount is supplied to the heater from the commencement of the phase control (the amount of time required until a target power amount is supplied to the heater from the commencement of the phase control hereinafter referred to as a "through-up time"). The setting of the fixed amount in the phase control disclosed in Japanese Patent Application Publication No. H10-91037 to a small value as described above has both positive and negative effects. On the positive side, the generation of flicker can be suppressed since the change in voltage supplied to the heater is moderated. On the negative side, conformity to the harmonic current related standards as described above cannot be ensured due to harmonic currents being generated over a long period of time.

Similarly, both positive and negative effects as described in the following are brought about when employing the phase control disclosed in Japanese Patent Application Publication No. H10-91037 and setting the fixed amount to a large value. That is, on the positive side, conformity to the harmonic current related standards can be ensured due to a shorter through-up time than the above-described case being realized. On the negative side, the generation of flicker cannot be suppressed since a rapid change takes place in the voltage supplied to the heater, which brings about an increase in inrush current.

Such problems are not unique to a heater provided to a fixing device, but also are observed in heaters in general when power is supplied thereto.

SUMMARY OF THE INVENTION

In view of such problems, the present invention provides a heater control device that is capable of supplying AC power to a heater while suppressing the generation of flicker and ensuring conformity to harmonic current related standards, a fixing device including such a heater control device, and an image forming apparatus.

The present inventors have found that, when the phase control is performed, a harmonic current of a given order tends to have a higher current value while the on-duty ratio in the phase control is within a predetermined range of on-duty ratios including a 50% on-duty ratio compared to while the on-duty ratio is not within the predetermined range of on-duty ratios.

In view of the above, one aspect of the present invention is a heater control device that performs phase control of AC power and supplies phase-controlled power to a heater, the heater control device including: a control unit configured to, in the phase control, gradually increase an on-duty ratio until a target power amount is supplied to the heater; and a judgment unit configured to judge whether or not the on-duty ratio is within a predetermined range of on-duty ratios including a 50% on-duty ratio, wherein the control unit (i) increases the on-duty ratio by a first amount while the on-duty ratio is within the predetermined range, and (ii) increases the on-duty ratio by a second amount while the on-duty ratio is not within the predetermined range, the first amount being greater than the second amount.

One aspect of the present invention is a heater control device that performs phase control of AC power and supplies phase-controlled power to a heater, the heater control device including: a control unit configured to, in the phase control, gradually increase an on-duty ratio until a target power amount is supplied to the heater by executing control of increasing the on-duty ratio by a fixed amount at a predetermined cycle; and a judgment unit configured to judge whether or not the on-duty ratio is within a predetermined range of on-duty ratios including a 50% on-duty ratio, wherein the control unit (i) executes the control at a first cycle while the on-duty ratio is within the predetermined range, and (ii) executes the control at a second cycle while the on-duty ratio is not within the predetermined range, the first cycle being shorter than the second cycle.

One aspect of the present invention is a fixing device including a heater control device pertaining to the present invention.

One aspect of the present invention is an image forming apparatus including a fixing device pertaining to the present invention.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings:

FIG. 8 is a table illustrating one example of a relation between a target power amounts set in the through-up control and a difference between a detection temperature and a target temperature of the fixing belt;

DESCRIPTION OF PREFERRED EMBODIMENTS

In the following, description is provided on embodiments of an image forming apparatus pertaining to the present invention.

Embodiment 1

Overall Structure of Image Forming Apparatus

Figure 1:
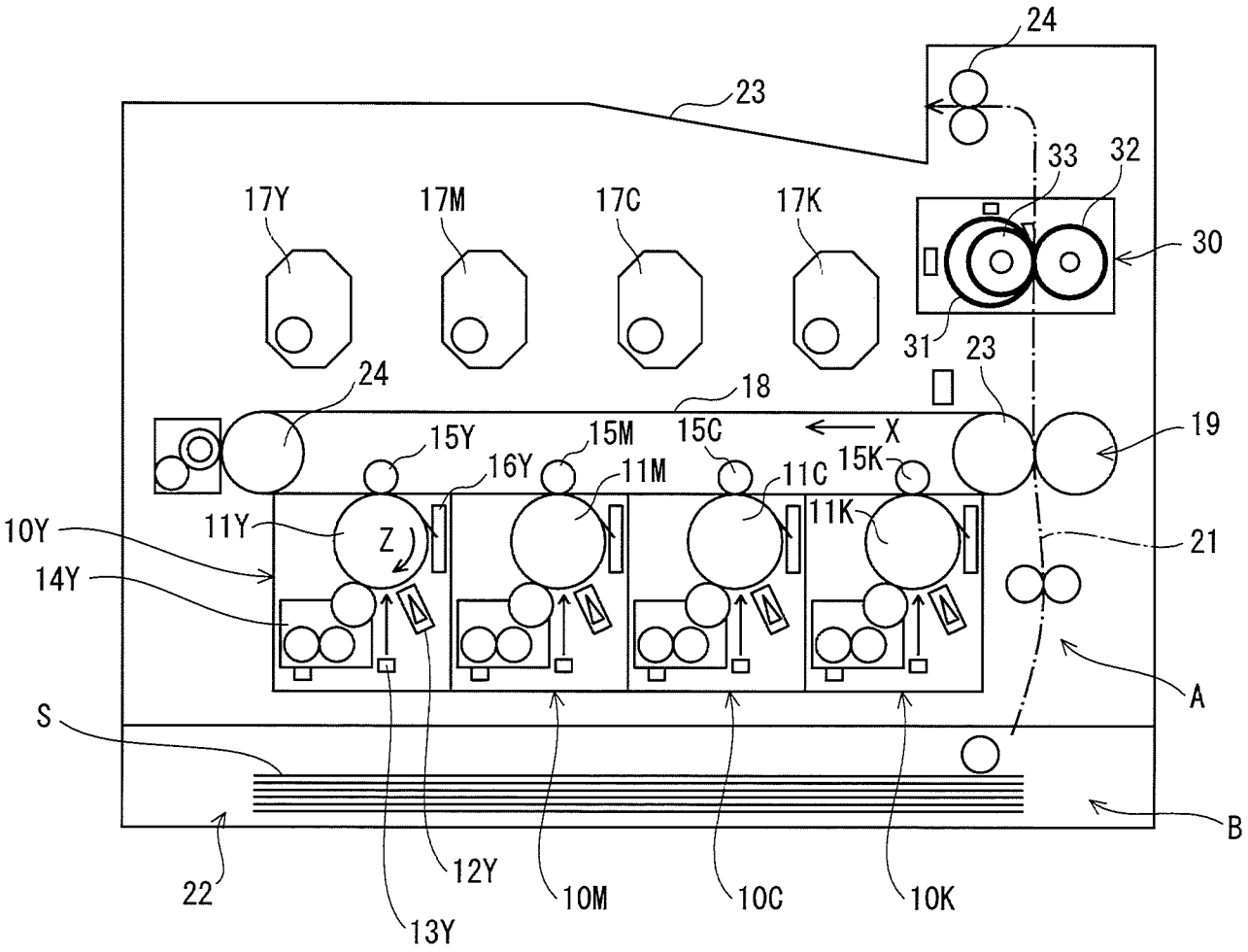
FIG. 1 is a schematic diagram for explaining a structure of a tandem-type color digital copier that is one example of an image forming apparatus pertaining to an embodiment of the present invention.

FIG. 1 is a schematic diagram for explaining a structure of a tandem-type color printer that is one example of an image forming apparatus pertaining to one embodiment of the present invention. Note that in the following, the tandem-type color printer is simply referred to as a printer. Based on image data, etc., input from an external terminal device or the like via a network (e.g., a LAN), the printer forms a full color image or a monochrome image onto a recording sheet, such as a piece of paper and an OHP sheet, according to a conventional electrophotographic printing method.

The printer includes an image forming section A and a paper feeding section B that is disposed below the image forming section A. The image forming section A forms a toner image on a recording sheet by using toner of the respective colors yellow (Y), magenta (M), cyan (C), and black (K). The paper feeding section B includes a paper feed cassette 22 that accommodates recording sheets S therein. The recording sheets S accommodated in the paper feed cassette 22 are supplied to the image forming section A one by one.

The image forming section A includes an intermediate transfer belt 18 that is wound about a pair of belt rotating rollers 23 and 24 in a rotatable state. The intermediate transfer belt 18, by being wound about the belt rotating rollers 23 and 24, is held in a horizontal state within the printer at a location substantially at the center of the printer. Further, an undepicted motor causes the intermediate transfer belt 18 to rotate in a direction indicated by the arrow X.

Further, below the intermediate transfer belt 18 in the image forming section A, processing units 10Y, 10M, 10C, 10K are disposed. The processing units 10Y, 10M, 10C, 10K are disposed in the stated order along the rotation direction of the intermediate transfer belt 18 facing a lower running path of the intermediate transfer belt 18. Each of the processing units 10Y, 10M, 10C, 10K forms a toner image on the intermediate transfer belt 18 by using toner of a corresponding color among the colors yellow (Y), magenta (M), cyan (C), and black (K).

Above the intermediate transfer belt 18, toner containers 17Y, 17M, 17C, 17K are each disposed so as to be located above a corresponding one of the processing units 10Y, 10M, 10C, 10K with the intermediate transfer belt 18 therebetween. Each of the toner containers 17Y, 17M, 17C, 17K holds toner of a corresponding one of the colors yellow (Y), magenta (M), cyan (C), and black (K), and supplies the toner of the corresponding color to the corresponding one of the processing units 10Y, 10M, 10C, 10K.

The processing units 10Y, 10M, 10C, 10K respectively include photosensitive drums 11Y, 11M, 11C, 11K. Each of the photosensitive drums 11Y, 11M, 11C, 11K is disposed in a rotatable state below the intermediate transfer belt 18 facing the lower running path of the intermediate transfer belt 18.

Further, each of the processing units 10Y, 10M, 10C, 10K, by using toner of a corresponding color supplied from the corresponding one of the toner containers 17Y, 17M, 17C, 17K, forms a toner image on a surface of the corresponding one of the photosensitive drums 11Y, 11M, 11C, 11K.

Here, note that the processing units 10Y, 10M, 10C, 10K have substantially similar structures, differing from each other only in terms of the color of the toner used thereby. As such, description will be provided in the following mainly focusing on the structure of the processing unit 10Y, while not referring to structures of the process units 10M, 10C, 10K unless necessary.

The photosensitive drum 11Y included in the processing unit 10Y is configured to rotate in a direction indicated by the arrow Z. In addition, the processing unit 10Y includes a charger 12Y that uniformly charges the surface of the photosensitive drum 11Y. The charger 12Y is disposed below the photosensitive drum 11Y and so as to face the photosensitive drum 11Y.

The processing unit 10Y further includes an exposure device 13Y and a developer 14Y. The exposure device 13Y is disposed downwards in the vertical direction with respect to the photosensitive drum 11Y at a position further downstream than the charger 12Y in a rotation direction of the photosensitive drum 11Y. The developer 14Y is disposed further downstream, in the rotation direction of the photosensitive drum 11Y, than a position where the surface of the photosensitive drum 11Y is to be exposed by the exposure device 13Y.

The exposure device 13Y forms an electrostatic latent image on the surface of the photosensitive drum 11Y, which has been uniformly charged by the charger 12Y in advance, by exposing the uniformly-charged surface of the photosensitive drum 11Y to laser light. The developer 14Y develops the electrostatic latent image formed on the surface of the photosensitive drum 11Y by using toner of the color Y.

The image forming section A further includes a primary transfer roller 15Y that is disposed above the processing unit 10Y. The primary transfer roller 15Y is disposed so as to face the photosensitive drum 11Y with the lower running path of the intermediate transfer belt 18 therebetween. When a transfer bias voltage is applied to the primary transfer roller 15Y, an electric field is formed between the primary transfer roller 15Y and the photosensitive drum 11Y.

Note that a corresponding one of primary transfer rollers 15M, 15C, 15K is disposed above each of the processing units 10M, 10C, 10K such that each of the primary transfer rollers 15M, 15C, 15K faces the corresponding one of the photosensitive drums 11M, 11C, 11K with the lower running path of the intermediate transfer belt 18 in between.

The respective toner images formed on the photosensitive drums 11Y, 11M, 11C, 11K undergo primary transfer of being transferred onto the intermediate transfer belt 18. The transferring of a toner image of a given one of the colors Y, M, C, K onto the intermediate transfer belt 18 is brought about by an electric field formed between a corresponding one of the primary transfer rollers 15Y, 15M, 15C, 15K and a corresponding one of the photosensitive drums 11Y, 11M, 11C, 11K. After primary transfer of the toner image, the photosensitive drum 11Y is cleaned by a cleaning member 16Y.

Note that when a full-color image is to be formed, the forming of a toner image of a corresponding color by each of the processing units 10Y, 10M, 10C, 10K is performed at a different timing such that the toner images formed on the respective photosensitive drums 11Y, 11M, 11C, 11K are transferred so as to be overlaid at the same location on the intermediate transfer belt 18.

On the other hand, when a monochrome image is to be formed, only a selected one of the processing units 10Y, 10M, 10C, 10K is caused to operate. As a result, a toner image is formed on a photosensitive drum included in the selected processing unit, and the toner image so formed is transferred onto a predetermined location of the intermediate transfer belt 18 by a corresponding primary transfer roller that is disposed facing the selected processing unit. For instance, when the processing unit 10K corresponding to toner of the color K is selected, a toner image is formed on the photosensitive drum 11K, and the toner image so formed is transferred onto the intermediate transfer belt 18 by the primary transfer roller 15K.

The location of the intermediate transfer belt 18 onto which the toner image has been transferred is conveyed as the intermediate transfer belt 18 rotates towards one end portion of the lower running path in the direction of the belt-rotating roller 23 (illustrated in FIG. 1 as a right end portion of the lower running path).

A portion of the intermediate transfer belt 18 wound around the belt-rotating roller 23 faces a secondary transfer roller 19 with a sheet transport path 21 therebetween. The secondary transfer roller 19 is disposed so as to press against the intermediate transfer belt 18. Due to this, a transfer nip is formed between the secondary transfer roller 19 and the intermediate transfer belt 18. Further, the secondary transfer roller 19 receives application of transfer bias voltage, whereby an electric field is formed between the secondary transfer roller 19 and the intermediate transfer belt 18.

A recording sheet S fed onto the sheet transport path 21 from the paper feed cassette 22 of the paper feeding section B is transported along the sheet transport path 21 so as to pass through the transfer nip formed by the secondary transfer roller 19 and the intermediate transfer belt 18. The toner image having been formed on the intermediate transfer belt 18 undergoes secondary transfer of being transferred onto the recording sheet S transported to the transfer nip. The transferring of the toner image onto the recording sheet S is brought about by the electric field formed between the secondary transfer roller 19 and the intermediate transfer belt 18.

The recording sheet S, having passed through the transfer nip, is transported to a fixing device 30 that is disposed above the secondary transfer roller 19. The fixing device 30 fixes the unfixed toner image onto the recording sheet S by the application of heat and pressure. The recording sheet S having a toner image fixed thereon is discharged onto a sheet discharge tray 23 by a pair of sheet discharge rollers 24.

<Structure of Fixing Device>

Figure 2:
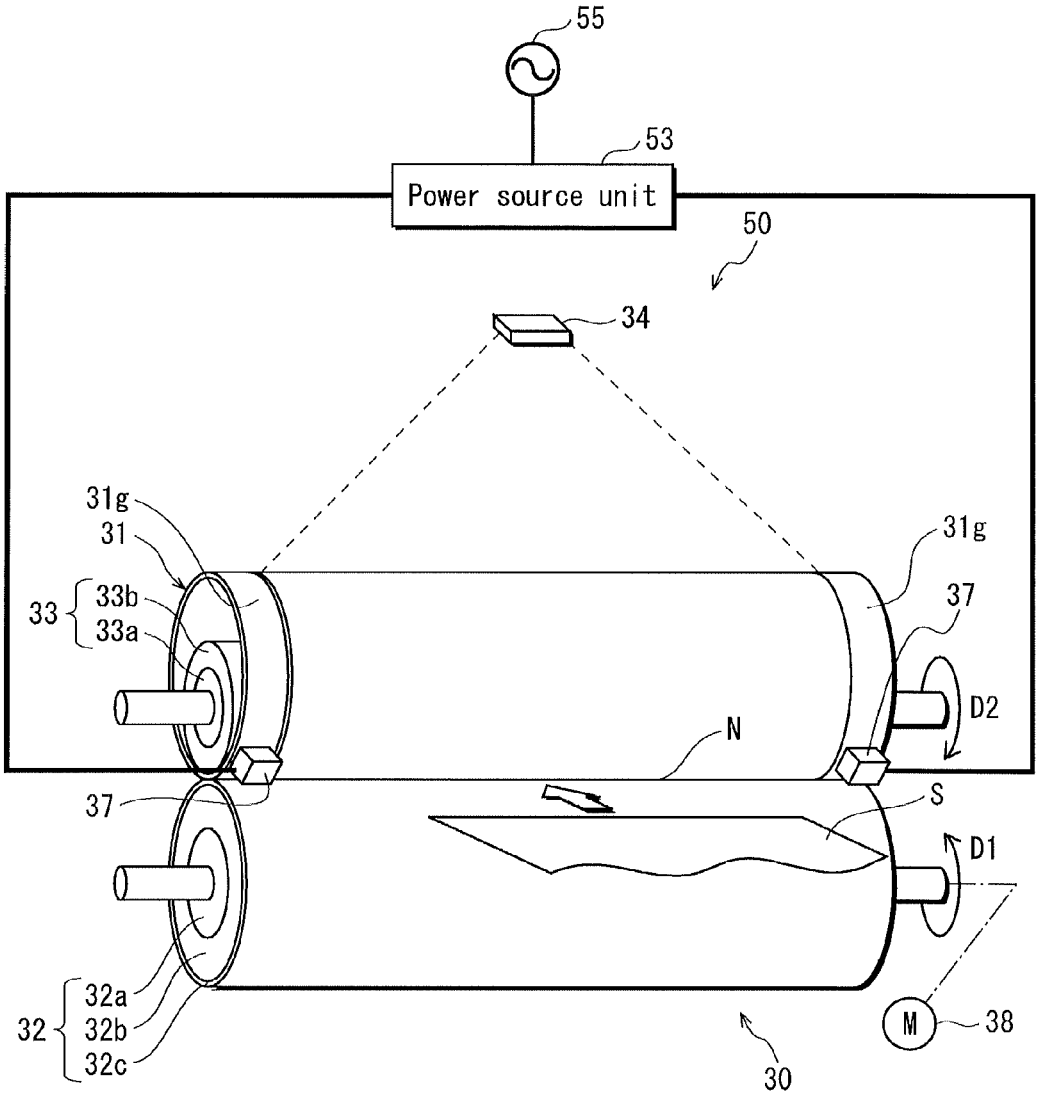
FIG. 2 is a schematic a perspective view for explaining a structure of a main part of a fixing device provided to the copier.
Figure 3:
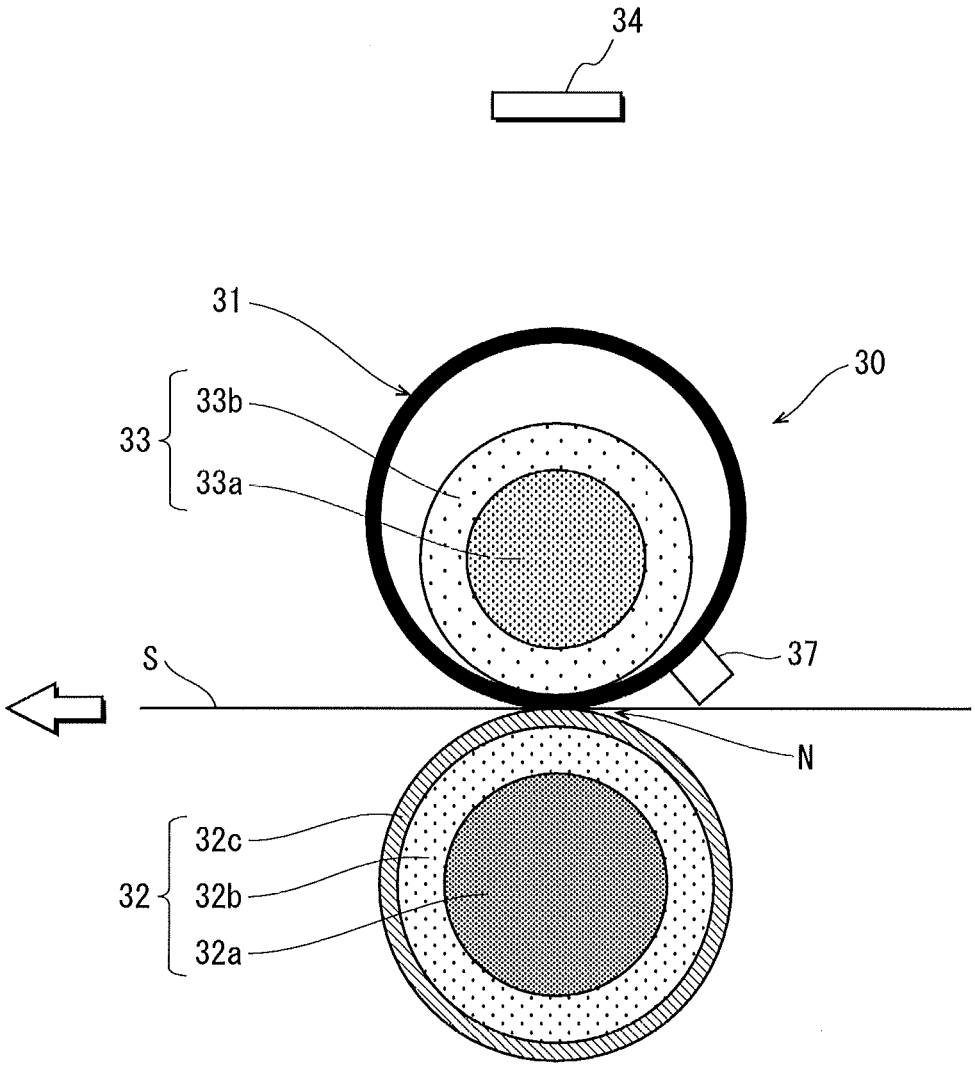
FIG. 3 is a schematic transverse sectional view of the fixing device.

FIG. 2 is a schematic perspective view for explaining a structure of a main part of the fixing device 30, and FIG. 3 is a schematic transverse sectional view of the fixing device 30. In the printer, the recording sheet S, transported from a lower direction with respect to the fixing device 30, passes through the fixing device 30 so as to be transported in an upper direction with respect to the fixing device 30 as illustrated in FIG. 1. Here, note that FIG. 2 illustrates the fixing device 30 such that the recording sheet S passes through the fixing device 30 from the front side of the drawing to the back side of the drawing. Further, FIG. 3 illustrates the fixing device 30 such that the recording sheet S passes through the fixing device 30 from the right side of the drawing to the left side of the drawing.

As illustrated in FIGS. 2 and 3, the fixing device 30 includes: a pressurizing roller 32; a fixing belt 31; and a fixing roller 33. The pressurizing roller 32 functions as a pressurizing member. The fixing belt 31 is disposed so as to rotate with an outer circumferential surface thereof pressed by the pressurizing roller 32. The fixing roller 33 is disposed inside a rotation path of the fixing belt 31 so as to press against an inner circumferential surface of the fixing belt 31.

The fixing belt 31 includes a resistance heating layer 31*b* (refer to FIG. 4) that functions as a heater. Specifically, the resistance heating layer 31*b* generates heat by power being supplied thereto. Further, the fixing belt 31 is put in a heated state when the resistance heating layer 31*b* generates heat, and rotates in the heated state. As such, the fixing belt 31 functions as a heating rotational body.

As for the shape of the fixing belt 31, for instance, a length of the fixing belt 31 in a direction of a rotational axis of the fixing belt 31 (a width direction of the fixing belt 31), which is perpendicular to a running direction of the fixing belt 31, is slightly greater than a length of an outer circumferential surface of the pressurizing roller 32 in a direction of a rotational axis of the pressurizing roller 32. Further, the fixing belt 31 has a cylindrical shape with a diameter slightly greater than a diameter of the pressurizing roller 32. Further, the fixing belt 31 and the pressurizing roller 32 are disposed such that the outer circumferential surface of the fixing belt 31 and the outer circumferential surface of the pressurizing roller 32 press against one another while the rotation axes thereof are arranged in a parallel state.

Due to the fixing belt 31 and the pressurizing roller 32 pressing against one another as described above, a fixing nip N is formed therebetween. The recording sheet S passes through the fixing nip N.

Figure 4:
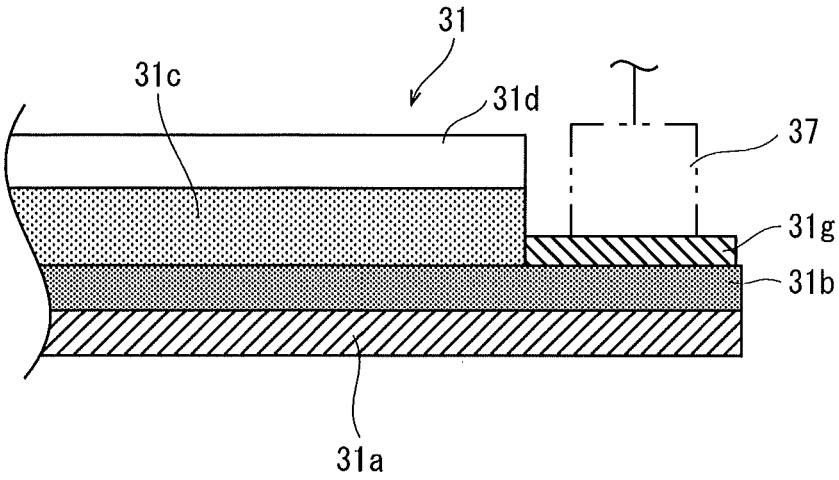
FIG. 4 is a transverse sectional view of one end portion of a fixing belt provided to the fixing device in a width direction perpendicular to a rotation direction of the fixing belt.

FIG. 4 is a transverse sectional view of one end portion of the fixing belt 31 in the rotational axis direction of the fixing belt 31, which is perpendicular to the running direction of the fixing belt 31. The fixing belt 31 includes a reinforcing layer 31*a* and the resistance heating layer 31*b*. The reinforcing layer 31*a* is a cylinder having uniform thickness made of, for example, polyimide (PI). The resistance heating layer 31*b* is disposed so as to entirely cover an outer circumferential surface of the reinforcing layer 31*a*. The resistance heating layer 31*b* is implemented by using a resistance heating element that generates Joule heat when electric current flows therethrough.

In the present embodiment, the resistance heating layer 31*b* is implemented by using a resistance heating element formed by uniformly dispersing conductive filler in PI, which is a heat-resistant resin. At each end portion of the resistance heating layer 31*b* in the rotational axis direction of the fixing belt 31, an electrode portion 31*g* is formed by using a conductive body, on an outer circumferential surface of the resistance heating layer 31*b* so as to entirely cover the outer circumferential surface of the end portion. Specifically, each of the electrode portions 31*g* is disposed so as to be located outwards in the rotational axis direction of the fixing belt 31 with respect to the fixing nip N.

Further, a power supply member 37 is disposed so as to be pressed against an outer circumferential surface of the electrode portion 31*g* such that a state of conduction is obtained between the power supply member 37 and the electrode portion 31*g*. Specifically, as illustrated in FIG. 2, each of the power supply members 37 is in sliding contact with the outer circumferential surface of the corresponding one of the electrode portions 31*g* at an area that is located further upstream than the fixing nip N in the rotation direction of the fixing belt 31 and that is in the vicinity of the fixing nip N.

Further, an elastic layer 31*c* is formed on an area of the outer circumferential surface of the resistance heating layer 31*b* located between the two electrode portions 31*g*. Further, a releasing layer 31*d* is formed on an outer circumferential surface of the elastic layer 31*c*.

As illustrated in FIG. 2, each of the power supply members 37 receives AC power from a commercial AC power source 55 via a harness. The power supplied to the power supply members 37 is that having undergone adjustment by the power source unit 53.

The power supply members 37 are each implemented, for instance, by using a conductive brush that is yielded by mixing carbon powder with powder such as copper powder and sintering the mixture. Each of the power supply members 37 comes into sliding contact with the corresponding one of the electrode portions 31*g* pressed thereagainst when the fixing belt 31 rotates. Due to this, the state of conduction between each of the power supply members 37 and the corresponding one of the electrode portions 31*g*, which are disposed so as to press against one another, is maintained.

Note that the power supply members 37 are not limited to being implemented by using conductive brushes. That is, as long as the power supply members 37 are able to maintain the state of conduction with the electrode portions 31*g* by coming into sliding contact with the electrode portions 31*g*, the power supply members 37 may be implemented without using conductive brushes in particular. For instance, each of the power supply members 37 may be implemented by using a conductive body formed of a metal, etc. Alternatively, each of the power supply members 37 may be implemented by plating a surface of an insulative body or the like with Cu, Ni, etc. Further, each of the power supply members 37 may be implemented as a rotational body such as a roller that rotates along with the rotation of the corresponding one of the electrode portions 31*g* while the contact therebetween is maintained.

The fixing device 30 further includes a temperature sensor 34 that measures a temperature of the outer circumferential surface of the fixing belt 31. Specifically, the temperature sensor 34 is disposed so as to face a location of the outer circumferential surface of the fixing belt 31 that differs by 180 degrees in a circumferential direction from a location of the outer circumferential surface of the fixing belt 31 against which the pressurizing roller 32 is pressed. Further, so as to enable the measurement of the temperature at all areas of the outer circumferential surface of the fixing belt 31 in the rotational axis direction of the fixing belt 31, the temperature sensor 34 is implemented, for instance, by using a multi-array thermopile that includes multiple thermopiles disposed in a linear arrangement. When implementing the temperature sensor 34 by using a multi-array thermopile as described above, the multi-array thermopile is disposed such that an alignment direction of the multiple thermopiles is in agreement with the width direction of the fixing belt 31. Specifically, the temperature sensor 34 is disposed so as to be able to measure the temperature of an area of the fixing belt 31 extending between both end portions in the width direction.

<Configuration of Control System of Fixing Device>

Figure 5:
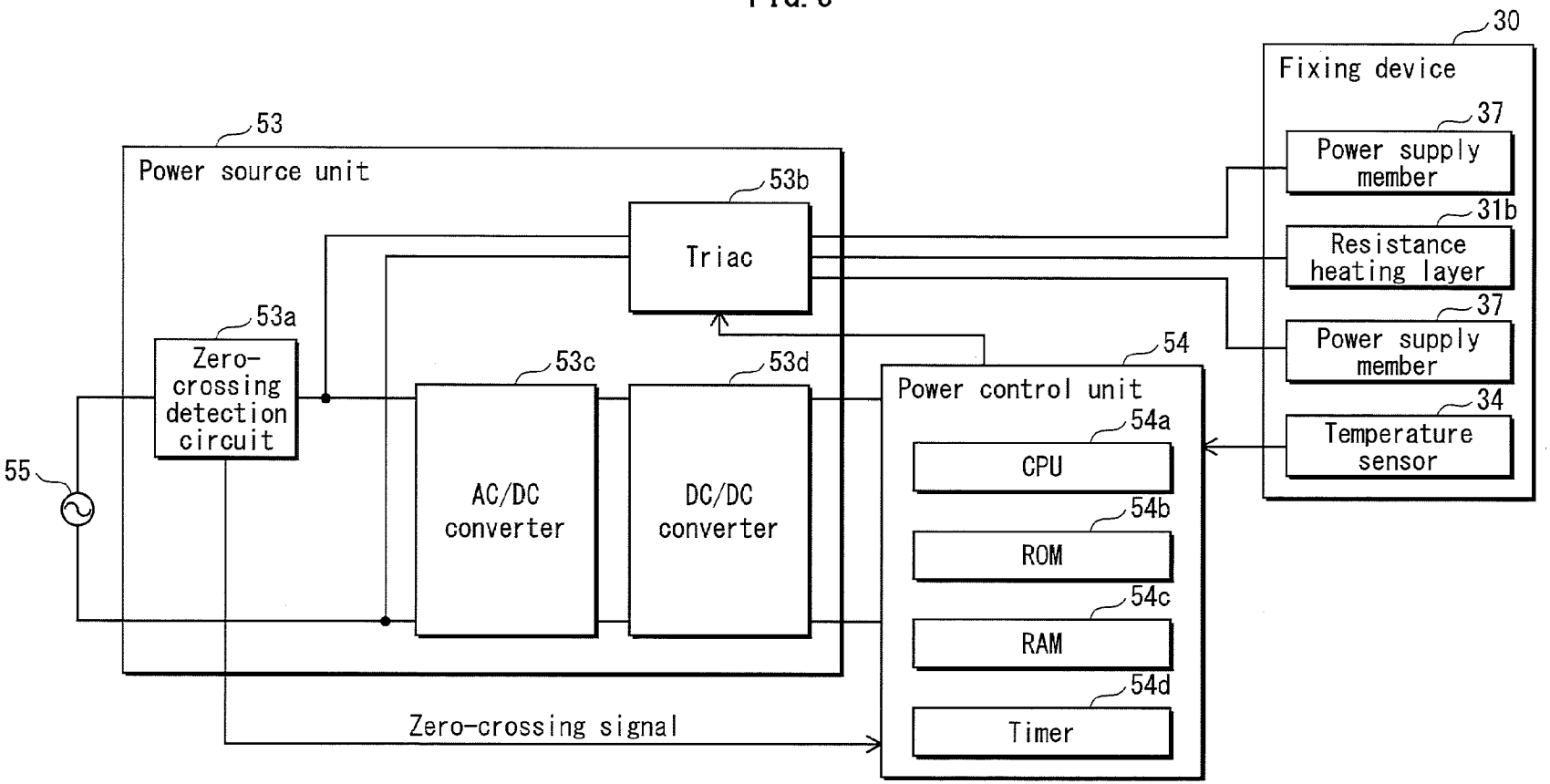
FIG. 5 is a block diagram illustrating a configuration of a power supply control unit (a heater control device) that performs control with respect to power to be supplied to a resistance heating layer (a heater) of the fixing belt.

FIG. 5 is a block diagram illustrating a power supply control unit (i.e., a heater control device) that performs control with respect to power to be supplied to the resistance heating layer 31*b*. As already described above, the resistance heating layer 31*b* is provided to the fixing belt 31 as a heater.

The heater control device includes the power source unit 53 and a power control unit 54 that controls the power source unit 53. The power source unit 53 performs phase control of AC power supplied from the commercial AC power source 55, and supplies phase-controlled AC power to the power supply members 37. Note that in Japan, the commercial AC power source 55 supplies AC power having a frequency of 50 Hz or 60 Hz.

The power source unit 53 includes a triac 53*b* functioning as a switching element. In specific, the triac 53*b* switches between an ON state for supplying AC power supplied from the commercial AC power source 55 to the resistance heating layer 31*b* of the fixing belt 31 and an OFF state for cutting-off the supply of AC power from the commercial AC power source 55 to the resistance heating layer 31*b*. Specifically, the triac 53*b* switches to the ON state when an ON signal is output from the power control unit 54, and after having been switched to the ON state, switches to the OFF state when a zero-crossing point is reached and the polarity of AC power supplied from the commercial AC power source 55 reverses.

The power source unit 53 further includes a zero-crossing detection circuit 53*a* that generates a zero-crossing signal when detecting a timing at which the voltage of AC power supplied from the commercial AC power source 55 equals ground level (i.e., zero voltage).

The zero-crossing signal generated by the zero-crossing detection circuit 53*a* is output to the power control unit 54. The power control unit 54 commences a measurement of time from a timing at which the zero-crossing signal is received, and when a timing corresponding to a target on-duty ratio arrives, outputs the ON signal to the triac 53*b*.

The power source unit 53 also includes an AC/DC converter 53*c* and a DC/DC converter 53*d*. The AC/DC converter 53*c* converts AC power supplied from the commercial AC power source 55 into DC power. The DC/DC converter 53*d* reduces the voltage of DC power output from the AC/DC converter 53*c* and supplies DC power thus converted to the power control unit 54.

The power control unit 54 includes: a central processing unit (CPU) 54 that executes various types of control; a read-only memory (ROM) 54*h*; a random access memory (RAM) 54*c*; and a timer 54*d*. The ROM 54*b* stores a program that executes the phase control described later in detail, values indicating upper and lower limits of a later-described harmonic current suppression range, etc. The RAM 54*c* is a volatile memory and functions as a work area when the program is executed. The timer 54*d* is used for the measurement of time performed to determine the timing for outputting the ON signal to the triac 53*b*.

The CPU 54*a* receives output from the temperature sensor 34, which detects the surface temperature of the fixing belt 31.

The triac 53*b* switches to the ON state when receiving the ON signal from the CPU 54*a*. The ON state of the triac 53*b* continues until a subsequent zero-crossing point. While the triac 53*b* is in the ON state, power output from the commercial AC power source 55 is supplied to the fixing belt 31 via the power supply members 37, and thus, the fixing belt 31 generates heat.

The CPU 54*a* is configured to perform warm-up control under specific conditions such as when the power of the printer is turned on and when the printer receives a print job while in the sleep mode, which is a power-saving mode of the printer. The warm-up control involves gradually increasing power supplied to the fixing belt 31 until the surface temperature of the fixing belt 31 reaches a target temperature.

Upon commencement of power supply to the heater, phase control is performed such that a ratio of a duration of the ON-state of the triac 53*b* within each half-cycle of AC power (i.e., the on-duty ratio of the triac 53*b*) gradually increases, in order to control a phase angle within each half-cycle of AC power supplied from the commercial power source 55. By phase control being performed as described above, through-up control which gradually increases the amount of power supplied to the resistance heating layer 31*b* is executed.

In the through-up control performed by the heater control device according to the present embodiment, the following control for suppressing harmonic currents (hereinafter referred to as "harmonic current suppression control") is executed. The harmonic current suppression control involves (i) setting as a "harmonic current suppression range" a range of on-duty ratios within which there is a risk of a harmonic current generated having a high current value, and (ii) increasing an amount by which the on-duty ratio is increased while the on-duty ratio is within the harmonic current suppression range so as to be greater compared to an amount by which the on-duty ratio is increased while the on-duty ratio is not within the harmonic current suppression range.

To ensure conformity to flicker-related restrictions and the harmonic current related standards described above, the harmonic current suppression range is determined based on harmonic currents of orders that are subject to restriction.

Figure 6:
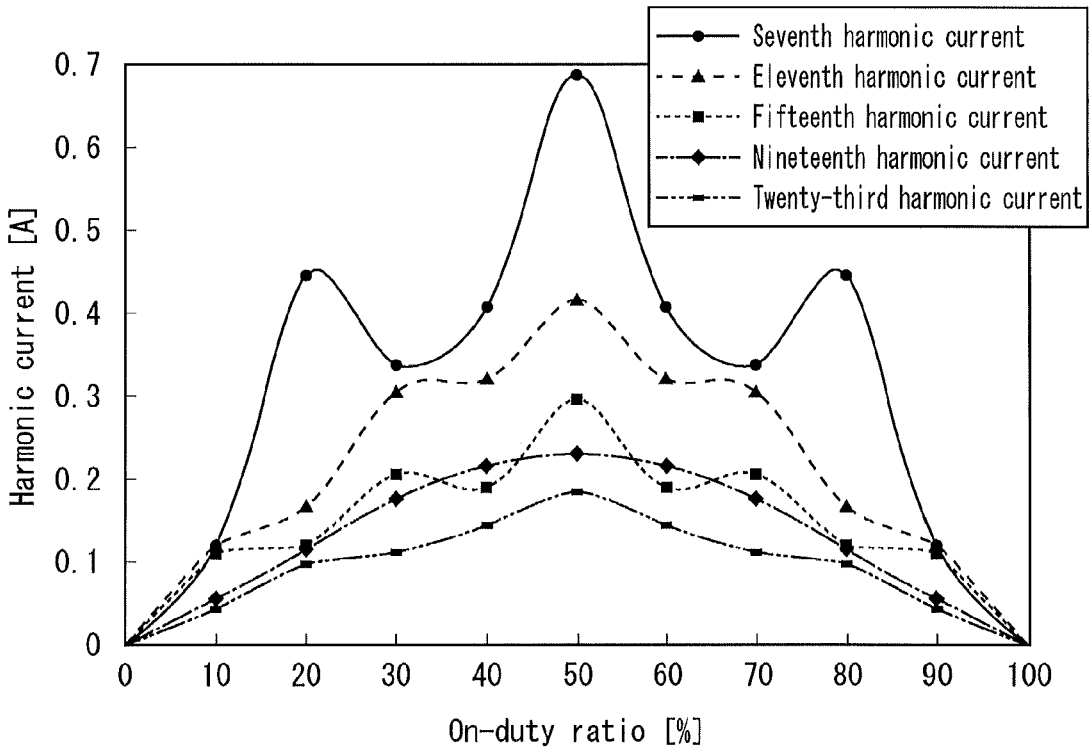
FIG. 6 is a graph illustrating a relation between on-duty ratios and harmonic currents observed through a simulation of harmonic currents generated when phase control is performed.

FIG. 6 is a graph illustrating a result of a simulation where changes in current values of harmonic currents that take place when the on-duty ratio increases were simulated by setting to a computer conditions under which harmonic currents are generated in the heater control device illustrated in FIG. 5.

In FIG. 6, the horizontal axis indicates the on-duty ratio within each half-cycle of AC power supplied from the commercial AC power source 55, and the vertical axis indicates current values of harmonic currents generated at the different on-duty ratios. Note that in FIG. 6, illustration is provided of only the seventh, eleventh, fifteenth, nineteenth, and twenty-third order harmonic currents as examples.

As can be seen when referring to FIG. 6, when the on-duty ratio is increased, a current value of a harmonic current of each order changes such that the current value is greatest (i.e., exhibits a peak) at a 50% on-duty ratio and is relatively great when the on-duty ratio is close to 50%.

When taking the seventh harmonic current as one example, the current value thereof rapidly increases to around 0.7 A when the on-duty ratio approaches 50%. Similarly, for each of the eleventh, fifteenth, nineteenth, and twenty-third harmonic currents, the current value thereof is greatest when the on-duty ratio of the triac 53*b* is approximately 50%.

This tendency of harmonic currents indicating the greatest current values when the on-duty ratio is around 50% was similarly observed for harmonic currents of orders other than those illustrated in FIG. 6.

Taking such results into consideration, in the present embodiment, the harmonic current suppression range is set as a range centered on a 50% on-duty ratio and covering on-duty ratios within a ±20% range from the 50% on-duty ratio (i.e., the harmonic current suppression range is a range of on-duty ratios from 30% to 70%, inclusive).

In the harmonic current suppression control, by referring to such a harmonic current suppression range, control is performed such that the on-duty ratio is increased by 5% each time a half-cycle of AC power elapses while the on-duty ratio is not within the harmonic current suppression range, whereas the on-duty ratio is increased by 10% each time a half-cycle of AC power elapses while the on-duty ratio is within the harmonic current suppression range. Due to this, the amount of time for which the on-duty ratio is within the harmonic current suppression range is shortened, and consequently, the period during which a current value of a harmonic current generated is high is shortened.

Figure 7:
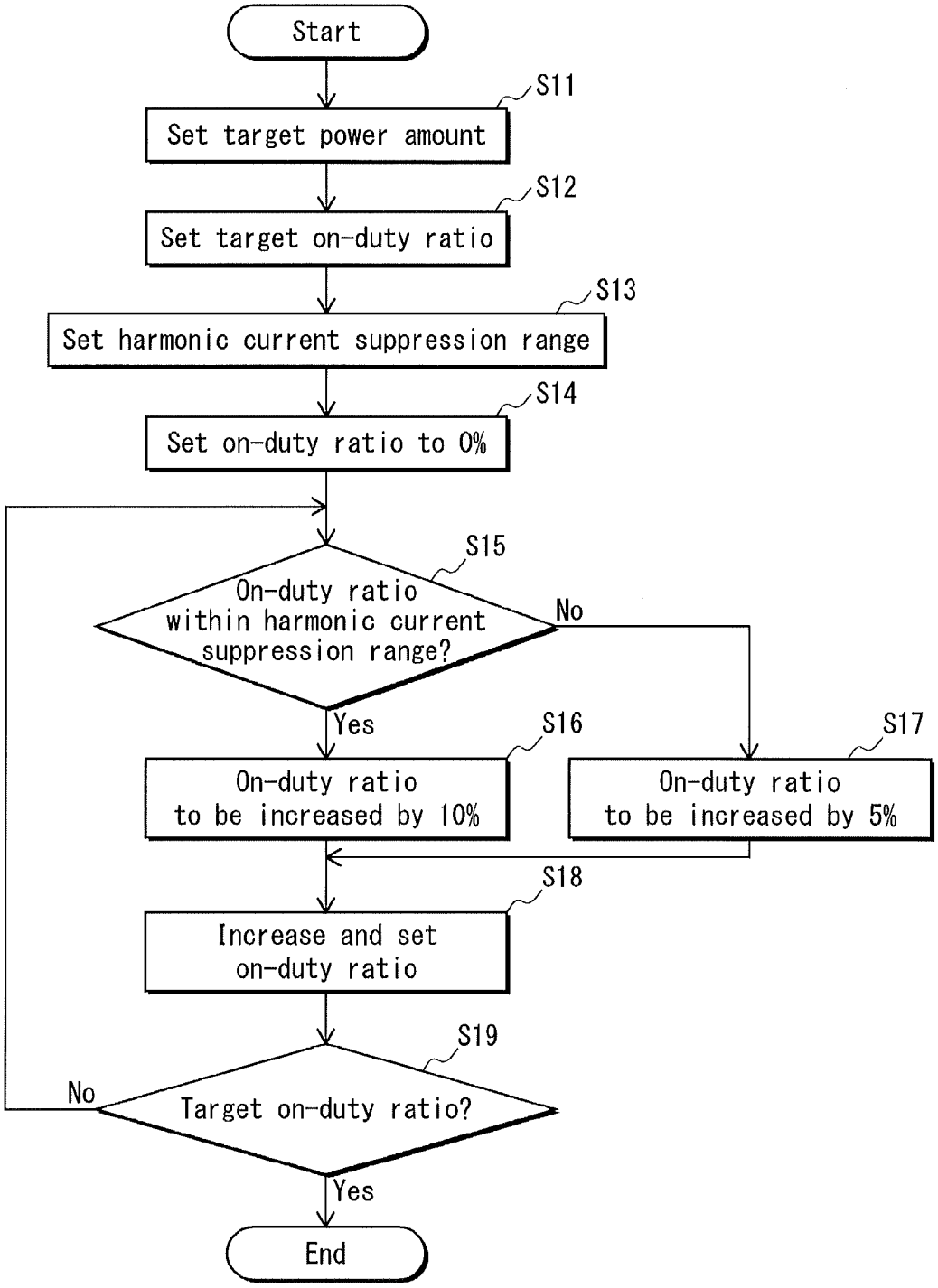
FIG. 7 is a flowchart illustrating processing procedures in harmonic current suppression control executed by the power supply control unit while through-up control is executed by performing the phase control.

FIG. 7 is a flowchart illustrating the contents of the through-up control executed by the power control unit 54 in the present embodiment. The through-up control is executed, for instance, under specific conditions such as (i) when the power of the printer is turned on, (ii) when the printer receives a print job while in the sleep mode, which is a power-saving mode of the printer, and (iii) when the power control unit 54, which is configured to acquire the temperature detected by the temperature sensor 34 (hereinafter referred to as a "detection temperature") at regular intervals, acquires from the temperature sensor 34 a detection temperature differing from a previously-acquired detection temperature.

Upon commencement of the through-up control (before power supply to the resistance heating layer 31*b* is commenced), the CPU 54*a* detects the surface temperature of the fixing belt 31 by using the temperature sensor 34. Further, based on a difference between the surface temperature so detected (i.e., the detection temperature) and a temperature, determined in advance, to be reached by the surface of the fixing belt 31 at the point when the through-up control is completed (hereinafter referred to as a "target temperature"), the CPU 54*a* determines an amount of power (hereinafter referred to as "a target power amount") that is to be supplied to the resistance heating layer 31*b* in order to eliminate the difference between the detection temperature and the target temperature (Step S11). Note that here, the target temperature is set to a fixing temperature required for fixing an unfixed toner image onto the recording sheet S.

The relationship between the target power amount and the difference between the detection temperature and the target temperature is determined in advance through experimentation, etc., and is stored in the ROM 54*b* of the power control unit 54 in the form of a table.

FIG. 8 illustrates one example of the table indicating the relationship between the target power amount and the difference between the detection temperature and the target temperature.

Note that in FIG. 8, the difference between the detection temperature and the target temperature is indicated as a positive value when the target temperature is higher than the detection temperature, although indicated without the use of the plus sign (+). In contrast, the difference between the detection temperature and the target temperature is indicated as a negative value when the target temperature is lower than the detection temperature, as indicated by the use of the minus sign (−).

Further, in the present embodiment, the maximum power amount that can be supplied to the resistance heating layer 31*b* is set to 1000 W. This maximum power amount of 1000 W corresponds to an amount of power supplied to the resistance heating layer 31*b* when the triac 53*b* is controlled so as to be in the ON state at a 100% on-duty ratio.

Note that according to the table illustrated in FIG. 8, when the target temperature is higher than the detection temperature by 10° C. or more (i.e., the difference between temperatures is 10° C. or greater), the target power amount is set to the maximum power amount that can be supplied to the resistance heating layer 31*b* (i.e., 1000 W).

In addition, according to the table illustrated in FIG. 8, when the detection temperature and the target temperature are equal (i.e., the difference between temperatures is 0° C.), the target power amount is set to 750 W, which is 75% of the maximum power amount. Here note that this power amount of 750 W, which corresponds to the situation where the difference between temperatures is 0° C., is hereinafter referred to as a "reference power amount".

Further, according to the table in FIG. 8, when the target temperature is higher than the detection temperature (i.e., when the difference between temperatures is indicated by a positive value), the target power amount increases by 2.5% from the reference power amount of 750 W for every 1° C. increase in the difference between temperatures. On the other hand, when the target temperature is lower than the detection temperature (i.e., when the difference between temperatures is indicated by a negative value), the target power amount decreases by 2.5% from the reference power amount of 750 W for every 1° C. decrease in the difference between temperatures.

Note that according to the table illustrated in FIG. 8, there is a possibility of the target on-duty ratio, which is the on-duty ratio at the point when the target power amount is supplied to the heater, falling within the harmonic current suppression range when the detection temperature exceeds the target temperature by a certain value. However, since the heat capacity of the fixing belt 31 including the resistance heating layer 31*b* is very small, the temperature of the fixing belt 31 immediately decreases when the recording sheet S passes through the fixing nip N, due to heat being conducted away from the fixing belt 31 by the recording sheet S. As such, it is unlikely that the detection temperature exceeds the target temperature by so great a temperature.

Nevertheless, even if such a situation were to take place by some rare accident, control as described in the following may be executed to cause the detection temperature to fall below the target temperature and thereby ensure that the control illustrated in FIG. 7 is executed after the detection temperature falls below the target temperature. That is, to cause the detection temperature to fall below the target temperature, the supply of power to the resistance heating layer 31*b* may be completely stopped, or the resistance heating layer 31*b* may be caused to continue generating heat at a low on-duty ratio that is below the lower limit of the harmonic current suppression range.

Since such a table as illustrated in FIG. 8 is set in advance, the CPU 54*a*, in Step S11, detects the surface temperature of the fixing belt 31 by using the temperature sensor 34, refers to the table illustrated in FIG. 8, and sets the target power amount according to the difference between the detected temperature and the target temperature, which is set in advance.

Following the setting of the target power amount in Step S11, a target on-duty ratio according to which control of the triac 53*b* is performed is set based on the target power amount (Step S12).

The target on-duty ratio can be calculated according to the target power amount and a phase angle of AC power supplied from the commercial AC power source 55. As a matter of course, the target on-duty ratio may also be determined by storing a table indicating a relationship between the target power amount and the target on-duty ratio to the ROM 54*b* in advance and by referring to such a table.

When the power of the printer is turned on, the surface temperature of the fixing belt 31 is low. As such, the difference between the target temperature and the detection temperature is indicated as a relatively great positive value. Specifically, since the difference in the target temperature and the detection temperature is usually at least 10° C. when the power of the printer is turned on, the CPU 54*a* sets the target power amount to 1000 W and the target on-duty ratio to 100% in such a case.

On the other hand, when an instruction for a print job is issued in a relatively short amount of time after the execution of a previous print operation, the difference between the target temperature and the detection temperature is indicated as a relatively small positive or negative value. Due to this, in such a case, the CPU 54*a* sets the target power amount to a value differing from 750 W by not much, and further, sets an on-duty ratio that corresponds to the target power amount so set as the target on-duty ratio.

When the target on-duty ratio is set in Step S12, the harmonic current suppression range, which is a predetermined range of on-duty ratios as described above, is read out from the ROM 54*b*, and the harmonic current suppression range is set to the RAM 54*c*, which functions as a working area (Step S13).

Here, as already discussed above, since a current value of a harmonic current generated indicates the greatest value when the on-duty ratio is around 50%, the harmonic current suppression range is set as a range centered on a 50% on-duty ratio and covering on-duty ratios within a ±20% range from the 50% on-duty ratio (i.e., the harmonic current suppression range is a range of on-duty ratios from 30% to 70%, inclusive).

Following the setting of the harmonic current suppression range, the CPU 54*a* sets the on-duty ratio to an initial value of 0% (Step S14).

In the phase control, within each half-cycle of AC power, the triac 53*b* is caused to switch between the ON state and the OFF state at the on-duty ratio having been set. The timing at which the triac 53*b* is switched to the ON state within a given half-cycle of AC power is determined according to an amount of time elapsing from the reception of the zero-crossing signal, which is output from the zero-crossing detection circuit 53*a*.

For instance, when the commercial AC power source supplies AC power having a frequency of 50 Hz and the on-duty ratio is 30%, the ON signal is output from the power control unit 54 to the triac 53*b* after 7 (=10×(100−30)/100) milliseconds have elapsed from the point when the zero-crossing signal is output.

Subsequently, the CPU 54*a* determines whether the on-duty ratio having been set is within the harmonic current suppression range (30%-70%) having been set in Step S13 (Step S15).

Upon commencement of the phase control, at first, the on-duty ratio is set to 0%, and thus is not within the harmonic current suppression range ("NO" in Step S15). Thus, processing proceeds to Step S17. In Step S17, 5% is set as the amount by which the on-duty ratio is to be increased for a subsequent half-cycle of AC power. As such, in Step S18, the CPU 54*a* updates the on-duty ratio by increasing the on-duty ratio by 5%.

When the on-duty ratio has been updated in Step S18, a check is performed of whether the on-duty ratio has reached the target on-duty ratio having been set in Step S12 (Step S19).

When the on-duty ratio has not yet reached the target on-duty ratio ("NO" in Step S19), processing returns to Step S15. Following this point, the CPU 54*a* repeatedly executes a sequence of processing corresponding to Steps S15, S17, S18, S19 until the on-duty ratio equals or exceeds the lower limit (30%) of the harmonic current suppression range. That is, until the on-duty ratio equals or exceeds the lower limit of the harmonic current suppression range, the on-duty ratio, according to which the triac 53*b* switches to the ON state in each half-cycle, is increased by 5% each time a half-cycle of AC power elapses.

While the triac 53*b* is in the ON state, the resistance heating layer 31*b* of the fixing belt 31 is supplied with AC power supplied from the commercial AC power source 55, and therefore, the resistance heating layer 31*b* is in a heat-generating state. Due to this, the surface temperature of the fixing belt 31 rises. As such, in the above-described case where the on-duty ratio, according to which the triac 53*b* is switched between the ON state and the OFF state, is gradually increased by 5% each time a half-cycle of AC power elapses, the amount of power supplied to the resistance heating layer 31*b* gradually increases accordingly, and consequently, the increase of the surface temperature of the fixing belt 31 over a unit time period increases.

Alongside the increase in the surface temperature of the fixing belt 31, the on-duty ratio of the triac 53*b* gradually increases, and when the on-duty ratio reaches the harmonic current suppression range (i.e., becomes greater than or equal to 30%) ("YES" in Step S15), processing proceeds to Step S16 in FIG. 7.

In Step S17, 10% is set as the amount by which the on-duty ratio is to be increased for a subsequent half-cycle of AC power. As such, in Step S18, the CPU 54*a* updates the on-duty ratio by increasing the on-duty ratio by 10%.

Subsequently, after determining that the on-duty ratio has not yet reached the target on-duty ratio ("NO" in Step S19), processing returns to Step S15. Following this point, the CPU 54*a* repeatedly executes a sequence of processing corresponding to Steps S15, S16, S18, S19 until the on-duty ratio exceeds the higher limit (70%) of the harmonic current suppression range.

Figure 9:
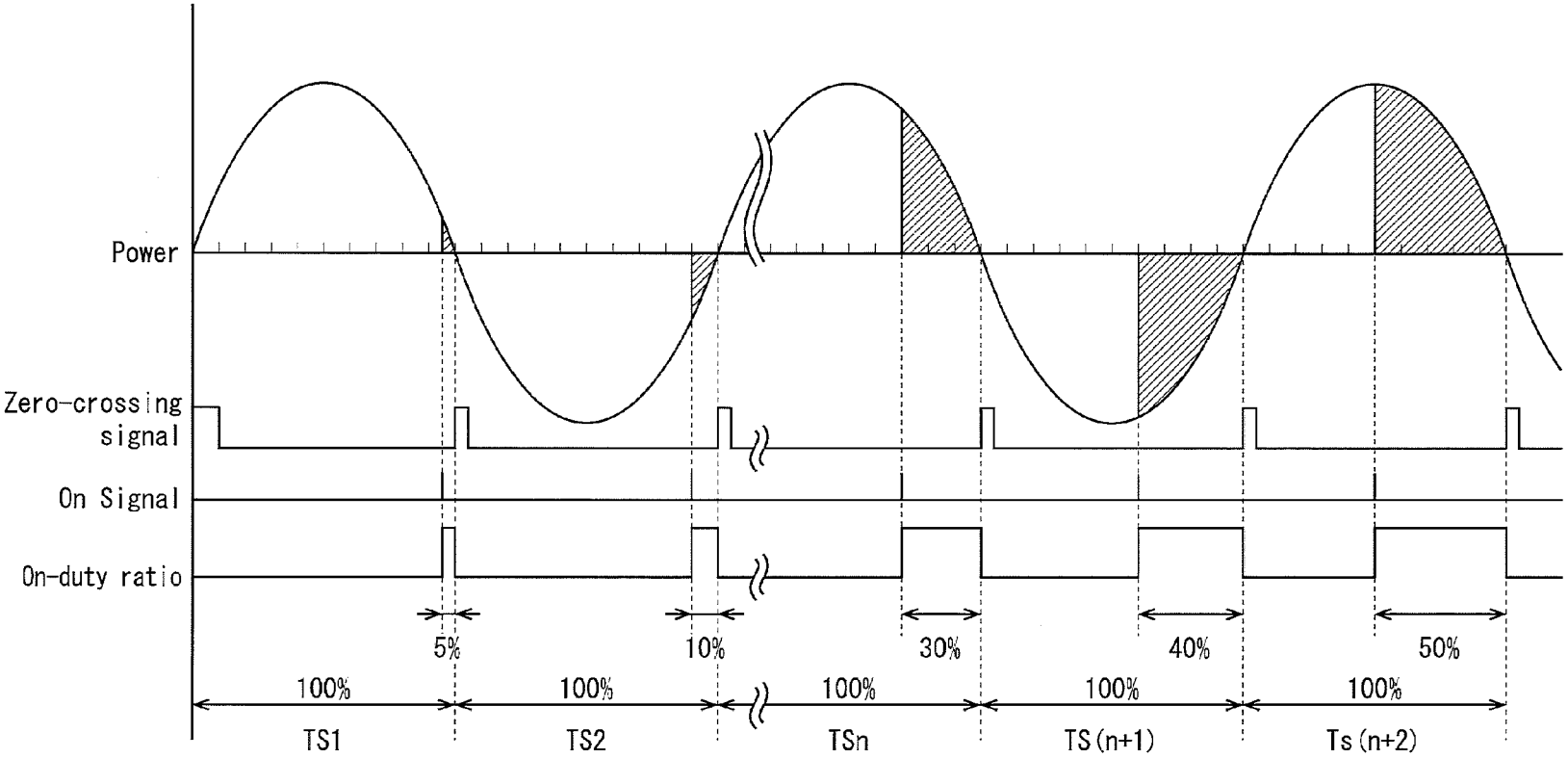
FIG. 9 is a timing chart illustrating a relation between (i) AC power supplied to a power source unit, (ii) a zero-crossing signal output from a CPU, and (iii) an ON signal that switches on a triac, in the through-up control.

FIG. 9 is a timing chart corresponding to when the through-up processing is executed and illustrates: a waveform of AC power supplied to the power source unit 53 from the commercial AC power source 55; timings at which the zero-crossing signal, which is output from the zero-crossing detection circuit 53*a*, is generated; and timings at which the ON signal, which is output from the power control unit 54 to the triac 53*b*, is generated.

As illustrated in FIG. 9, within a half-cycle TS1 with respect to which the on-duty ratio is set to 5%, the timer 54*d* commences the measurement of time when the zero-crossing signal is output from the zero-crossing detection circuit 53*a*. Subsequently, when a time period corresponding to 95% of the half-cycle TS1 of AC power supplied to the power source unit 53 elapses, the ON signal is output from the power control unit 54 for triggering the switching of the triac 53*b* from the OFF state to the ON state, and hence, the triac 53*b* switches to the ON state. Following this, the triac 53*b* switches to the OFF state at a timing at which the zero-crossing signal is output from the zero-crossing detection circuit 53*a*.

Due to this, AC power supplied to the power source unit 53 is supplied to the resistance heating layer 31*b* of the fixing belt 31 such that an amount of power equivalent to a phase angle corresponding to a specific time period within the half-cycle TS1 is supplied to the resistance heating layer 31*b* of the fixing belt 31. Here, the specific time period is a time period immediately preceding the termination of the half-cycle TS1 and corresponding to 5% of the half period TS1.

During a half-cycle TS2 subsequent to the half-cycle TS1 with respect to which the on-duty ratio is set to 5%, the ON signal is output to the triac 53*b* such that the on-duty ratio for the time period TS2 is 10%. The on-duty ratio is increased in a similar manner for each of the subsequent half-cycles, and for instance, in a half-cycle subsequent to the half-cycle TS2, the on-duty ratio is increased to 15%.

Further, as illustrated in FIG. 9, in a half-cycle TSn, the triac 53*b* is switched to the ON state such that the on-duty ratio within the half-cycle TSn is 30%. Due to this, in the subsequent half-cycle TS(n+1), the triac 53*b* is switched to the ON state such that the on-duty ratio within the half-cycle TS(n+1) is 40%. Here, note that the on-duty ratio of 40% within the half-cycle TS(n+1) is yielded by increasing the on-duty ratio within the half-cycle TSn (30%) by 10%.

In a half-cycle TS(n+2) subsequent to the half-cycle TS(n+1), the triac 53*b* is switched to the ON state such that the on-duty ratio within the half-cycle is 50%. The on-duty ratio of 50% within the half-cycle TS(n+2) is yielded by increasing the on-duty ratio within the half-cycle TS(n+1) (40%) by 10%.

Returning to FIG. 7, when the on-duty ratio exceeds the upper limit (70%) of the harmonic current suppression range ("NO" in Step S15), processing proceeds to Step S17, where 5% is set as the amount by which the on-duty ratio is to be increased for a subsequent half-cycle of AC power. Further, the on-duty ratio is updated by being increased by 5% (Step S18).

Following this, the CPU 54*a* repeatedly executes the sequence of processing corresponding to Steps S15, S17, S18, S19 until the on-duty ratio equals the target on-duty ratio. When the on-duty ratio equals the target on-duty ratio ("YES" in Step S19), the through-up control is terminated.

Figure 10:
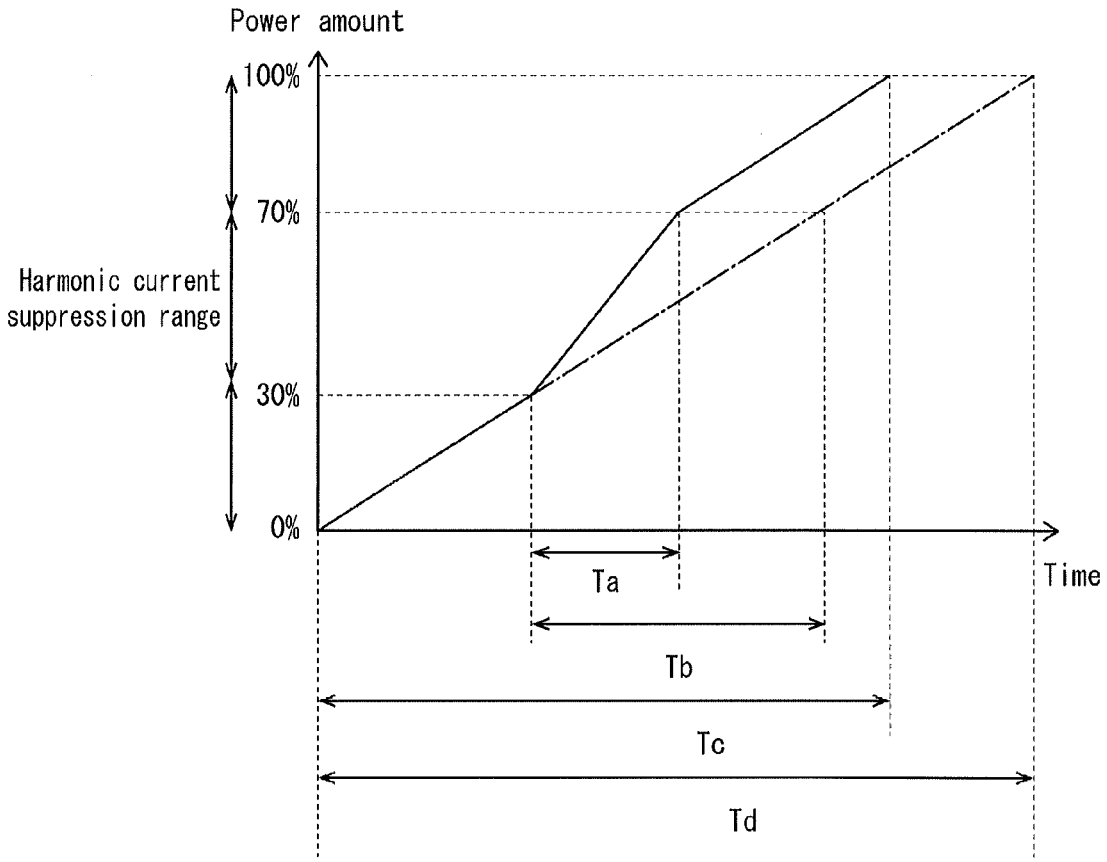
FIG. 10 is a graph that schematically illustrates an amount of time required for power supplied to the fixing belt to reach a target power amount (100%) through the through-up control.

FIG. 10 is a graph that schematically illustrates the amount of time required for the amount of power supplied to the resistance heating layer 13*b* of the heating belt 31 to reach the target power amount (100%) through the execution of the through-up control.

In FIG. 10, the solid line indicates a case where the through-up control pertaining to the present embodiment is executed, whereas the dashed-dotted line indicates a case where conventional control is executed where the on-duty ratio is increased by a fixed amount of 5% at all times each time a half-cycle elapses (such case hereinafter referred to as a "comparative case"). Here it should be noted that, in a strict sense, the relationship between the increase in on-duty ratio and the change in amount of power supplied to the heater, occurring along with the elapse of time, is not linear-proportional since AC power has a sinusoidal waveform. Nevertheless, in FIG. 10, the above-described relationship is schematically illustrated by employing a liner graph for the sake of facilitating the understanding of the relationship between the through-up control pertaining to the present embodiment and through-up control as conventionally performed.

In the comparative example, the on-duty ratio of the triac 53*b* is increased by an amount of 5% each time a half-cycle of AC power elapses. As such, an amount of time Td is required until the target power amount is reached. Further, a time period Tb, which is a time period during which power is output to the heater while the on-duty ratio is within the harmonic current suppression range (30%-70%) in the comparative example, is relatively long.

In contrast, according to the present embodiment, the on-duty ratio is increased by an amount of 10% each time a half-cycle of AC power elapses while the on-duty ratio is within the harmonic current suppression range. As such, a time period Ta, which is a time period during which power is output while the on-duty ratio is within the harmonic current suppression range according to the present embodiment, is considerably shorter than the time period Tb in the comparative example.

Due to this, according to the present embodiment, within the overall through-up time required until the target power amount is supplied to the heater, the time period during which power is output while the on-duty ratio is within the harmonic current suppression range is shortened. Hence, the generation of a harmonic current having a high current value is suppressed, and on the whole, the average of current values of a harmonic current is suppressed.

In the present embodiment, description has been provided that while the on-duty ratio is within the harmonic current suppression range, the on-duty ratio is increased by 10% for each half-cycle elapsing, which is a greater amount than the amount (5%) by which the on-duty ratio is increased for each half-cycle elapsing while the on-duty ratio is not within the harmonic current suppression range. However, the amount by which the on-duty ratio is increased when the harmonic current suppression range is reached is not limited to such.

In particular, the amount by which the on-duty ratio is increased when the harmonic current suppression range is reached may be set such that, when the on-duty ratio reaches the lower limit of the harmonic current suppression range at a given half-cycle, the on-duty ratio for the subsequent half-cycle, by being updated and increased only once, exceeds the upper limit of the harmonic current suppression range.

For instance, the amount by which the on-duty ratio is increased when the harmonic current suppression range is reached may be set such that, assuming the harmonic current suppression range is a range between a lower limit Da % and an upper limit Db % inclusive and the on-duty ratio when first equaling or exceeding the lower limit Da % is Dc %, the amount ΔD by which the on-duty ratio is increased for the subsequent half-cycle is greater than a difference between the upper limit Db % and the on-duty ratio Dc % (i.e., $\Delta D > Db - Dc$). When setting the amount ΔD by which the on-duty ratio is increased when the harmonic current suppression range is reached in such a manner, the on-duty ratio for the subsequent half-cycle exceeds the upper limit Db % of the harmonic current suppression range. Hence, it is ensured that a harmonic current having a high current value is not generated during the subsequent half-cycle.

Alternatively, the amount ΔD by which the on-duty ratio is increased when the harmonic current suppression range is reached may be set to a difference (Db−Da) % between the upper limit and the lower limit of the harmonic current suppression range. That is, in the present embodiment, the amount ΔD may be set to 40%, by performing a calculation of upper limit (70%)−lower limit (30%).

According to the above-described configuration, when the on-duty ratio first takes a value within the harmonic current suppression range at a given half-cycle, the on-duty ratio for the subsequent half-cycle, by being updated and increased only once, exceeds the upper limit of the harmonic current suppression range and is no longer within the harmonic current suppression range. Due to this, the generation of a harmonic current having a high current value can be suppressed with an increased level of efficiency.

According to the present embodiment, the on-duty ratio is increased by a relatively great amount while the on-duty ratio is within the harmonic current suppression range. This results in a reduction of the amount of time during which power supply to the heater is performed while the on-duty ratio is within the harmonic current suppression range (when referring to FIG. 10, the amount of time Tb in the comparative example is reduced to the amount of time Ta according to the present embodiment). Accordingly, the overall through-up time is also reduced. However, it should be noted that certain problems arise when the overall through-up time Tc according to the present embodiment becomes extremely short. That is, there is a risk of flicker being generated due to a rapid change in voltage taking place, which renders the phase control according to the present embodiment meaningless.

When it can be foreseen that the overall through-up time Tc would become extremely short due to the on-duty ratio being increased by a relatively great amount while the on-duty ratio is within the harmonic current suppression range, so as to prevent the problems as described above, the following countermeasures can be taken. That is, the on-duty ratio may be increased by a slightly smaller amount than described above while the on-duty ratio is within the harmonic current suppression range while ensuring conformity with the harmonic current related standards, and/or the on-duty ratio may be increased by a smaller amount than described above while the on-duty ratio is not within the harmonic current suppression range. By taking such countermeasures, the overall through-up time Tc can be extended to such an extent that the above-described problems do not take place.

Embodiment 2

Embodiment 2 differs from embodiment 1 only in terms of the contents of the through-up control.

Figure 11:
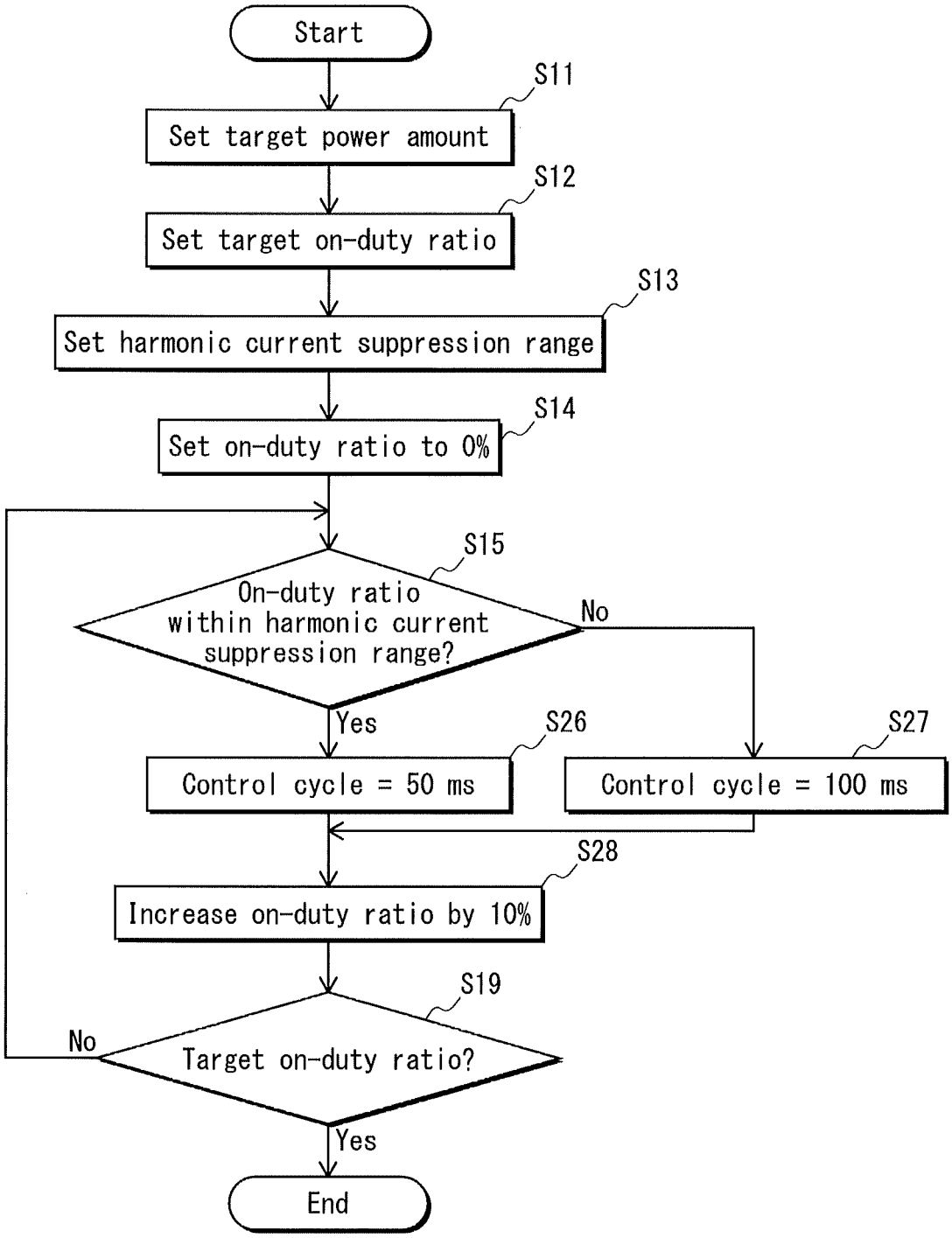
FIG. 11 is a flowchart illustrating processing procedures in harmonic current suppression control executed by a power supply control unit in another embodiment.

FIG. 11 is a flowchart illustrating processing procedures involved in the through-up control according to embodiment 2.

As illustrated in the flowchart in FIG. 11, the through-up control according to the present embodiment includes processing corresponding to Steps S26, S27, S28, which respectively replace Steps S16, S17, S18 in the flowchart in FIG. 7. Other than this, the processing in the through-up control according to the present embodiment (corresponding to Steps S11 through S15, and S19) is similar to that according to FIG. 7.

In the though-up control illustrated in the flowchart in FIG. 11, the on-duty ratio is not increased each time a half-cycle of AC power elapses. Rather, the power control unit 54 generates clock signals each indicating a periodic cycle (hereinafter referred to as a "control cycle") at which control of updating the on-duty ratio is to be executed, and further, the on-duty ratio is increased by a fixed amount each time the control is executed.

Specifically, in the present embodiment, AC power supplied from the commercial AC power source 55 has a frequency of 50 Hz (i.e., each half-cycle of AC power has a duration of 10 ms). Further, while the on-duty ratio is within the harmonic current suppression range, the control of updating the on-duty ratio is executed at a control cycle of 50 ms, whereas while the on-duty ratio is not within the harmonic current suppression range, the control of updating the on-duty ratio is executed at a control cycle of 100 ms. In addition, the on-duty ratio is increased by a fixed amount of 10% each time the control is executed regardless of whether the on-duty ratio is within or not within the harmonic current suppression range. Note that the frequency of the clock signal indicating the control cycle at which the control is to be executed, in each of the cases, is calculated, for instance, by performing frequency-division with respect to the frequency of AC power.

According to the flowchart in FIG. 11, when it is determined that the on-duty ratio is not within the harmonic current suppression range (30%-70%) in Step S15 ("NO" in Step S15), processing proceeds to Step S27, where the control cycle at which the control is executed of increasing the on-duty ratio by the fixed amount is set to 100 ms. During the 100 ms period following this point, the on-duty ratio remains unchanged, and the triac 53*b* is controlled according to the on-duty ratio having been set.

That is, in the above-described case, the on-duty ratio remains unchanged until a time period of 100 ms is measured by the timer 54*d* of the power control unit 54. When the 100 ms time period elapses, processing proceeds to Step S28, where the on-duty ratio is updated by being increased by the fixed amount of 10%.

Subsequently, processing proceeds to Step S19, and when determining that the on-duty ratio has not reached the target on-duty ratio in Step S19 ("NO" in Step S19), processing returns to Step S15. Following this point, a sequence of processing corresponding to Steps S15, S27, S28, S19 is repeatedly performed until the on-duty ratio equals or exceeds the lower limit (30%) of the harmonic current suppression range.

By the above-described sequence of processing being repeatedly performed, there arrives a point when the on-duty ratio equals or exceeds the lower limit (30%) of the harmonic current suppression range since the on-duty ratio is repeatedly updated by the fixed amount of 10% in Step S28. When it is determined in Step S15 that the on-duty ratio has equaled or exceeded the lower limit (30%) of the harmonic current suppression range ("YES" in Step S15), processing proceeds to Step S26, where the control cycle at which the control is executed of increasing the on-duty ratio by the fixed amount is set to 50 ms.

When a time period of 50 ms is measured by the timer 54*d* of the power control unit 54, processing proceeds to Step S28, where the on-duty ratio is updated by being increased by the fixed amount of 10%.

Subsequently, processing proceeds to Step S19, and when determining that the on-duty ratio has not reached the target on-duty ratio in Step S19 ("NO" in Step S19), processing returns to Step S15. Following this point, a sequence of processing corresponding to Steps S15, S26, S28, S19 is repeatedly performed until the on-duty ratio exceeds the higher limit (70%) of the harmonic current suppression range.

As described up to this point, when the on-duty ratio enters the harmonic current suppression range (equals or exceeds 30%), the control of increasing the on-duty ratio by the fixed amount of 10% is executed at the control cycle of 50 ms, which is shorter than the control cycle of 100 ms at which the control is executed while the on-duty ratio is not within the harmonic current suppression range. Due to this, while the on-duty ratio is within the harmonic current suppression range, the on-duty ratio is updated at shorter intervals compared to while the on-duty ratio is not within the harmonic current suppression range.

As a result, similar as in embodiment 1, the amount of time during which power is output to the heater while the on-duty ratio is within the harmonic current suppression range can be shortened, and accordingly, the time period during which a harmonic current generated has a high current value can be shortened.

Subsequently, when it is determined in Step S15 that the on-duty ratio having been set in Step S28 has exceeded the harmonic current suppression range (70%) ("NO" in Step S15), processing proceeds to Step S27, where the control cycle at which the control is executed of increasing the on-duty ratio by the fixed amount is set to 100 ms.

Subsequently, processing proceeds to Step S19, where it is determined that the on-duty ratio has not reached the target on-duty ratio ("NO" in Step S19), and further returns to Step S15. Following this point, until it is determined in Step S19 that the on-duty ratio has reached the target on-duty ratio, a sequence of processing corresponding to Steps S15, S26, S28, S19 is repeatedly performed. When the on-duty ratio set in Step S28 finally reaches the target on-duty ratio ("YES" in Step S19), the harmonic current suppression control and the through-up control are terminated.

In the present embodiment, the control cycle at which the control is executed of increasing the on-duty ratio is set to 50 ms while the on-duty ratio is within the harmonic current suppression range. This control cycle of 50 ms is an integer multiple of the half-cycle (10 ms) of AC power supplied from the commercial AC power source 55. However, the present invention is not limited to this Nevertheless, it is desirable that the control cycle at which the control is executed while the on-duty ratio is within the harmonic current suppression range be set such that the interval between executions of the control is at least longer than or equal to a half-cycle of AC power supplied from the commercial AC power source 55. That is, it is desirable that the control cycle at which the control is executed while the on-duty ratio is within the harmonic current suppression range be set to at least 10 ms (=1000/(50×2)) when AC power supplied from the commercial AC power source 55 has a frequency of 50 Hz, and to at least approximately 8.34 ms (=1000/(60×2)) when AC power supplied from the commercial AC power source 55 has a frequency of 60 Hz.

If, contrary to the above, the control cycle at which the control is executed while the on-duty ratio is within the harmonic current suppression range were to be set such that the interval between executions of the control is shorter than a half-cycle of AC power, a situation would be brought about where, during certain half-cycles, the on-duty ratio is updated at least twice. Here, it should be noted that, even if the control were to be executed twice within a given half-cycle, the control of the on-duty ratio during a subsequent half-cycle would be performed based on the on-duty ratio set in the final execution of the control within the given half-cycle. In other words, the previous execution(s) of the control in the given half-cycle are meaningless and only bring about an increase in processing load exerted on the CPU 54. Further, if the control cycle at which the control is executed while the on-duty ratio is within the harmonic current suppression range were to be set as described above, the on-duty ratio would be updated more frequently than necessary, and hence, there is a risk of the amount of power supplied to the resistance heating layer 31*b* increasing rapidly, which is undesirable.

Further, it should be noted that the numerical values explained in the above-described embodiments are mere examples used for the sake of explaining the present invention. As such, regardless of the numerical values that are provided in the embodiments herein, each of (i) the harmonic current suppression range including the 50% on-duty ratio of 50%, (ii) the amount by which the on-duty ratio is to be increased while the on-duty ratio is within the harmonic current suppressing range, and (iii) the amount by which the on-duty ratio is to be increased while the on-duty ratio is not within the harmonic current suppressing range is to be determined by means of experimentation, etc. This is since, in order to suppress the generation of flicker and to ensure conformity to harmonic-current related standards imposing restriction on harmonic currents of certain orders, the above-described values should be determined through experimentation by actually using a printer to take into consideration factors such as the type of heater included in the printer and the heating ability that the fixing device included in the printer is required to have.

<Modifications>

In the above, the description has been provided on the present invention based on specific embodiments thereof. However, the present invention should not be construed as being limited to such embodiments, and various modifications such as those described in the following should be construed as being within the spirit and scope of the present invention.

(1) In the embodiments, the harmonic current suppression range is set to a range including a 50% on-duty ratio. While the on-duty ratio is within such a harmonic current suppression range, harmonic currents having high current values, not limited to only specific orders of harmonic currents, are generated. Thus, by setting the harmonic current suppression range so as to include a 50% on-duty ratio, it is possible to suppress the generation of harmonic currents having high current values, regardless of the orders of the harmonic currents.

However, as illustrated in the graph in FIG. 6, it can be seen that, for instance, the seventh harmonic current indicates peaks where the current value thereof increases when the on-duty ratio is around 20% and when the on-duty ratio is around 80%, in addition to when the on-duty ratio is within the harmonic current suppression range including the 50% on-duty ratio. Taking this into consideration, when a harmonic current has a peak other than that corresponding to the harmonic suppression range including a 50% on-duty ratio and a current value of the harmonic current equals or exceeds a threshold value specified under harmonic current related standards at such peak, restriction may be performed with respect to the harmonic current within a predetermined range of on-duty ratios including such a peak.

Further, when performing restriction with respect to a harmonic current at such a peak where the current value equals or exceeds a predetermined threshold value, a range including the peak is to be set as another harmonic current suppression range that is separate from the harmonic current suppression range including the on-duty ratio of 50%. When setting an additional harmonic current suppression range as described above, a modification is to be made such that (i) the on-duty ratio is increased by a greater amount while the on-duty ratio is within the additional harmonic current suppression range compared to while the on-duty ratio is not within the harmonic current suppression range or the additional harmonic current suppression range, or (ii) the control of increasing the on-duty ratio is executed at a shorter control cycle while the on-duty ratio is within the additional harmonic current suppression range compared to while the on-duty ratio is not within the harmonic current suppression range or the additional harmonic current suppression range. The control performed in such a modification is similar to the control performed by referring to the harmonic current suppression range in the embodiments.

By making such a modification, restriction can be performed of a harmonic current having a high current value generated within a range of on-duty ratios that is separate from the harmonic current suppression range including the on-duty ratio of 50%. As such, a heater control device that satisfies harmonic current related standards to a further extent can be provided.

(2) In the embodiments, the amount by which the on-duty ratio is increased is switched between two values, one value corresponding to while the on-duty ratio is within the harmonic current suppression range and the other value corresponding to while the on-duty ratio is not within the harmonic current suppression range. However, provided that the on-duty ratio is increased by a greater amount while the on-duty ratio is within the harmonic current suppression range compared to while the on-duty ratio is not within the harmonic current suppression range, while the on-duty ratio is within the harmonic current suppression range, the amount by which the on-duty ratio is increased may switch between multiple values, and similarly, while the on-duty ratio is not within the harmonic current suppression range, the amount by which the on-duty ratio is increased may be switch between multiple values. For instance, control may be performed such that, within the harmonic current suppressing range, the amount by which the on-duty ratio is increased gradually increases as approaching the 50% on-duty ratio.

(3) In the embodiments, description has been provided on the fixing device pertaining to the present invention based on the fixing device 30, which has a structure where the resistance heating layer 31*b* (i.e., the heater) is included in the fixing belt 31 (i.e., the fixing rotational body). However, the present invention is not limited to this.

Figure 12:
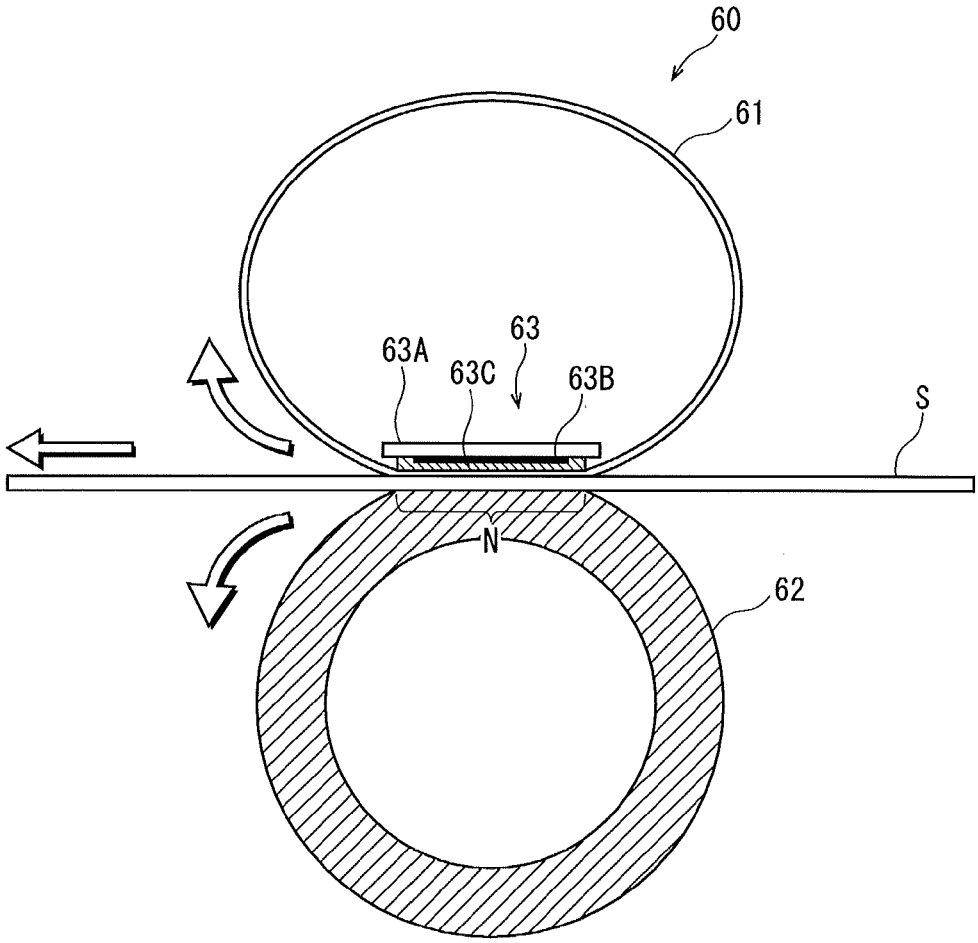
FIG. 12 is a schematic cross-sectional view for explaining a structure of another example of a fixing device.

For instance, the fixing device pertaining to the present invention may be a fixing device 60 as illustrated in FIG. 12. The fixing device 60 includes: an endless fixing belt 61; a pressurizing roller 62; and an elongated heating member 63 that is disposed, in an unmovable state, in an inner circumferential portion of the fixing belt 61. The elongated heating member 63 includes: a strip-shaped support plate 63A; a resistance heating layer 63B layered onto the support plate 63A; and a coating layer 63C covering the resistance heating layer 63B.

In the fixing device 60 illustrated in FIG. 12, the heating member 63 is in contact with the inner circumferential surface of the rotating fixing belt 61 such that a fixing nip N is formed by an outer circumferential surface of the fixing belt 61 being pressed by an outer circumferential surface of the pressurizing roller 62. Power is supplied to the resistance heating layer 63B via electrode portions (undepicted in FIG. 12) that are provided to both end portions of the support plate 63A in an elongated direction of the heating member 63. Further, power is supplied to the electrode portions according to the phase control as described in embodiment 1 or embodiment 2.

Figure 13:
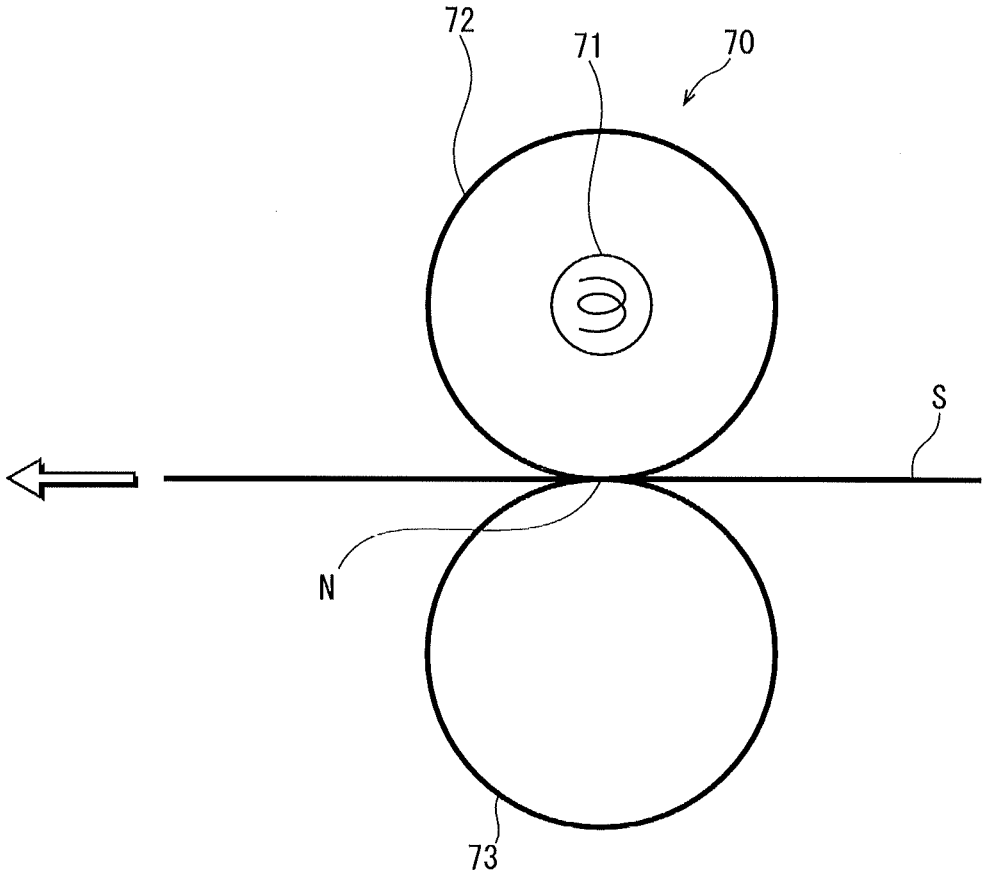
FIG. 13 is a schematic cross-sectional view for explaining a structure of yet another example of a fixing device.

Further, the fixing device pertaining to the present invention is not limited to including a resistance heating layer as a heater. Alternatively, the fixing device pertaining to the present invention may have a structure as illustrated in FIG. 13 where a halogen lamp heater, etc., is included therein as a heater. When referring to FIG. 13, a fixing device 70 includes: a hollow fixing roller 72 as a fixing rotational body; a halogen heater lamp 71 disposed inside the fixing roller 72; and a pressurizing roller 73. An outer circumferential surface of the fixing roller 72 is pressed by an outer circumferential surface of the pressurizing roller 73, thereby forming a fixing nip N through which the recording sheet S passes. Even when the fixing device pertaining to the present invention is implemented by using the fixing device 70 illustrated in FIG. 13, the through-up control as described in the embodiments is executed with respect to power to be supplied to the halogen heater lamp 71.

(4) In the embodiments, description has been provided while taking a tandem-type color digital copier as an example. However, the present invention is not limited to this, and is also applicable to image forming apparatus such as a FAX and a Multiple Function Peripheral (MFP). Alternatively, the present invention may be applied to a monochrome image forming apparatus.

In addition, the heater control device pertaining to the present invention is not limited to being used to control a heater in a fixing device, and may be used for controlling other types of heaters.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A heater control device that performs phase control of AC power and supplies phase-controlled power to a heater, the heater control device comprising:

a control unit configured to, in the phase control, gradually increase an on-duty ratio until a target power amount is supplied to the heater; and a judgment unit configured to judge whether or not the on-duty ratio is within a predetermined range of on-duty ratios including a 50% on-duty ratio, wherein the control unit (i) increases the on-duty ratio by a first amount while the on-duty ratio is within the predetermined range, and (ii) increases the on-duty ratio by a second amount while the on-duty ratio is not within the predetermined range, the first amount being greater than the second amount.

2. The heater control device of claim 1, wherein the first amount is such that, when the on-duty ratio is increased by the first amount, the on-duty ratio after increase is no longer within the predetermined range.

3. The heater control device of claim 2, wherein the first amount equals a difference between an upper limit and a lower limit of the predetermined range.

4. The heater control device of claim 1, wherein in addition to judging whether or not the on-duty ratio is within the predetermined range, the judgment unit judges whether or not the on-duty ratio is within another range of on-duty ratios that is separate from the predetermined range, the predetermined range and the other range being set due to a current value of a harmonic current of a specific order that is to be restricted having a plurality of peaks, the current value changing as the on-duty ratio changes and equaling or exceeding a predetermined threshold value at the peaks, and the control unit increases the on-duty ratio by a third amount while the on-duty ratio is within the other range, the third amount being greater than the second amount.

5. A fixing device that fixes an unfixed toner image onto a recording sheet by causing the recording sheet to come into contact with a fixing rotational body, the fixing device comprising, as a power supply control unit for controlling power supply to a heater that heats the fixing rotational body, the heater control device of claim 1.

6. The fixing device of claim 5, wherein the heater is a resistance heating element.

7. The fixing device of claim 6, wherein the fixing rotational body is a fixing belt that includes a heating layer composed of the resistance heating element.

8. The fixing device of claim 6, wherein the fixing rotational body is a fixing belt, and an elongated heating member including a heating layer composed of the resistance heating element comes into sliding contact with an inner circumferential surface of the fixing belt and heats the fixing belt.

9. The fixing device of claim 5, wherein the fixing rotational body is a hollow fixing roller, and the heater is a halogen heater that is disposed inside the hollow fixing roller.

10. An image forming apparatus comprising the fixing device of claim 5.

11. A heater control device that performs phase control of AC power and supplies phase-controlled power to a heater, the heater control device comprising:

a control unit configured to, in the phase control, gradually increase an on-duty ratio until a target power amount is supplied to the heater by executing control of increasing the on-duty ratio by a fixed amount at a predetermined cycle; and a judgment unit configured to judge whether or not the on-duty ratio is within a predetermined range of on-duty ratios including a 50% on-duty ratio, wherein the control unit (i) executes the control at a first cycle while the on-duty ratio is within the predetermined range, and (ii) executes the control at a second cycle while the on-duty ratio is not within the predetermined range, the first cycle being shorter than the second cycle.

12. The heater control device of claim 11, wherein a cycle length of the first cycle is equal to or longer than a half-cycle of the AC power.

13. The heater control device of claim 11, wherein in addition to judging whether or not the on-duty ratio is within the predetermined range, the judgment unit judges whether or not the on-duty ratio is within another range of on-duty ratios that is separate from the predetermined range, the predetermined range and the other range being set due to a current value of a harmonic current of a specific order that is to be restricted having a plurality of peaks, the current value changing as the on-duty ratio changes and equaling or exceeding a predetermined threshold value at the peaks, and the control unit executes the control at a third cycle while the on-duty ratio is within the other range, the third cycle being shorter than the second cycle.

14. A fixing device that fixes an unfixed toner image onto a recording sheet by causing the recording sheet to come into contact with a fixing rotational body, the fixing device comprising, as a power supply control unit for controlling power supply to a heater that heats the fixing rotational body, the heater control device of claim 11.

15. The fixing device of claim 14, wherein the heater is a resistance heating element.

16. The fixing device of claim 15, wherein the fixing rotational body is a fixing belt that includes a heating layer composed of the resistance heating element.

17. The fixing device of claim 15, wherein the fixing rotational body is a fixing belt, and an elongated heating member including a heating layer composed of the resistance heating element comes into sliding contact with an inner circumferential surface of the fixing belt and heats the fixing belt.

18. The fixing device of claim 14, wherein the fixing rotational body is a hollow fixing roller, and the heater is a halogen heater that is disposed inside the hollow fixing roller.

19. An image forming apparatus comprising the fixing device of claim 14.

* * * * *